US011320758B2

(12) United States Patent
Isohara

(10) Patent No.: US 11,320,758 B2
(45) Date of Patent: May 3, 2022

(54) IMAGE FORMING SYSTEM, TRANSPORT CONTROL METHOD, AND PROGRAM

(71) Applicant: Konica Minolta, Inc., Tokyo (JP)

(72) Inventor: Hideo Isohara, Fuchu (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 17/317,197

(22) Filed: May 11, 2021

(65) Prior Publication Data

US 2021/0356880 A1 Nov. 18, 2021

(30) Foreign Application Priority Data

May 12, 2020 (JP) ..... JP2020-084075

(51) Int. Cl.

| | |
|---|---|
| ***G03G 15/01*** | (2006.01) |
| ***G03G 15/23*** | (2006.01) |
| ***G03G 15/00*** | (2006.01) |
| ***G03G 15/20*** | (2006.01) |

(52) U.S. Cl.

CPC ..... *G03G 15/0194* (2013.01); *G03G 15/0131* (2013.01); *G03G 15/0189* (2013.01); *G03G 15/2021* (2013.01); *G03G 15/231* (2013.01); *G03G 15/238* (2013.01); *G03G 15/6573* (2013.01); *G03G 15/6582* (2013.01); *G03G 15/6585* (2013.01); *G03G 2215/0119* (2013.01)

(58) Field of Classification Search

CPC ..... G03G 15/2021; G03G 15/238; G03G 15/6573; G03G 15/6582; G03G 15/6585; G03G 15/0194; G03G 15/0131; G03G 15/0189; G03G 15/231; G03G 2215/0119

See application file for complete search history.

(56) References Cited

U.S. PATENT DOCUMENTS

| | | | | |
|---|---|---|---|---|
| 9,250,595 | B1 * | 2/2016 | Sreekumar | B41J 2/01 |
| 2012/0087690 | A1 * | 4/2012 | Kudo | G03G 15/238 399/82 |
| 2012/0120422 | A1 * | 5/2012 | Hitaka | G03G 15/205 358/1.9 |

FOREIGN PATENT DOCUMENTS

JP 2012203870 A 10/2012

* cited by examiner

*Primary Examiner* — Joseph S Wong
(74) *Attorney, Agent, or Firm* — Cantor Colburn LLP

(57) ABSTRACT

An image forming system includes: a first image forming apparatus including a first fixer that fixes an image formed on a recording medium to the recording medium; a second image forming apparatus including a second fixer that fixes an image formed on the recording medium to the recording medium, the second image forming apparatus being connected to a downstream side of the first image forming apparatus in a transport direction of the recording medium; and a hardware processor that determines first transport control content in which the recording medium is transported in the first image forming apparatus and the second image forming apparatus, and sets second transport control content so that the recording medium that has been processed by the first fixer is processed in a different position by the second fixer.

13 Claims, 15 Drawing Sheets

IMAGE FORMING SYSTEM, TRANSPORT CONTROL METHOD, AND PROGRAM

CROSS REFERENCE TO RELATED APPLICATIONS

This present invention claims priority under 35 U.S.C. § 119 to Japanese Patent Application No. 2020-084075, filed on May 12, 2020, the entire content of which is incorporated herein by reference.

BACKGROUND

Technological Field

The present invention relates to an image forming system, a transport control method, and a program.

Description of the Related Art

In recent years, a tandem image forming system in which two image forming apparatuses are connected in series to perform double-sided printing etc. has been put to practical use (see, for example, JP 2012-203870 A).

Such a tandem image forming system can perform so-called additional printing, in which, for example, a black image is formed on the front side of paper by an upstream image forming apparatus (upstream machine), and, for example, red is additionally formed on the front side of the paper by a downstream image forming apparatus (downstream machine).

Alternatively, when performing double-sided printing, a tandem image forming system can form an image on the front side of paper by an upstream machine, and form another image on the back side of the paper by a downstream machine.

Thus, a tandem image forming system can improve productivity as compared with the case of performing double-sided printing with one image forming apparatus. Such a tandem image forming system is generally applied to a production print machine pursuing high productivity.

However, a conventional tandem machine as in JP 2012-203870 A can cause a problem that cannot happen in a single image forming apparatus.

Specifically, there is a problem that damage such as wrinkles or large curl is likely to occur to paper as a recording medium because the paper passes through a fuser of an upstream machine and a fuser of a downstream machine with its position, that is, the front and back sides and the front and rear edges in a transport direction unchanged.

Here, if wrinkles occur in paper, the quality as printed matter deteriorates, so printing must be performed again. On the other hand, if large curl occurs in paper, not only the quality deteriorates but also a jam is likely to occur before the paper is ejected to the outside of the machine. The risk of such damage is typically greater when a recording medium is thin paper.

As a measure to deal with problems as described above, it is conceivable to add a dedicated apparatus for correcting curl, wrinkles, etc. However, this leads to an increase in the size of the entire system and an increase in cost.

SUMMARY

It is an object of the present invention to provide an image forming system, a transport control method, and a program capable of preventing, at low cost, damage from occurring to a recording medium when printing is performed by two upstream and downstream image forming apparatuses.

To achieve the abovementioned object, according to an aspect of the present invention, an image forming system reflecting one aspect of the present invention comprises: a first image forming apparatus including a first fixer that fixes an image formed on a recording medium to the recording medium; a second image forming apparatus including a second fixer that fixes an image formed on the recording medium to the recording medium, the second image forming apparatus being connected to a downstream side of the first image forming apparatus in a transport direction of the recording medium; and a hardware processor that determines first transport control content in which the recording medium is transported in the first image forming apparatus and the second image forming apparatus, when an image is formed on the recording medium both in the first image forming apparatus and in the second image forming apparatus, and sets second transport control content so that the recording medium that has been processed by the first fixer is processed in a different position by the second fixer, when in the first transport control content, the recording medium that has been processed by the first fixer is processed in the same position by the second fixer.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiments of the present invention will be described with reference to the drawings. However, the scope of the invention is not limited to the disclosed embodiments.

[Overall Configuration of Image Forming System 10]

Figure 1:
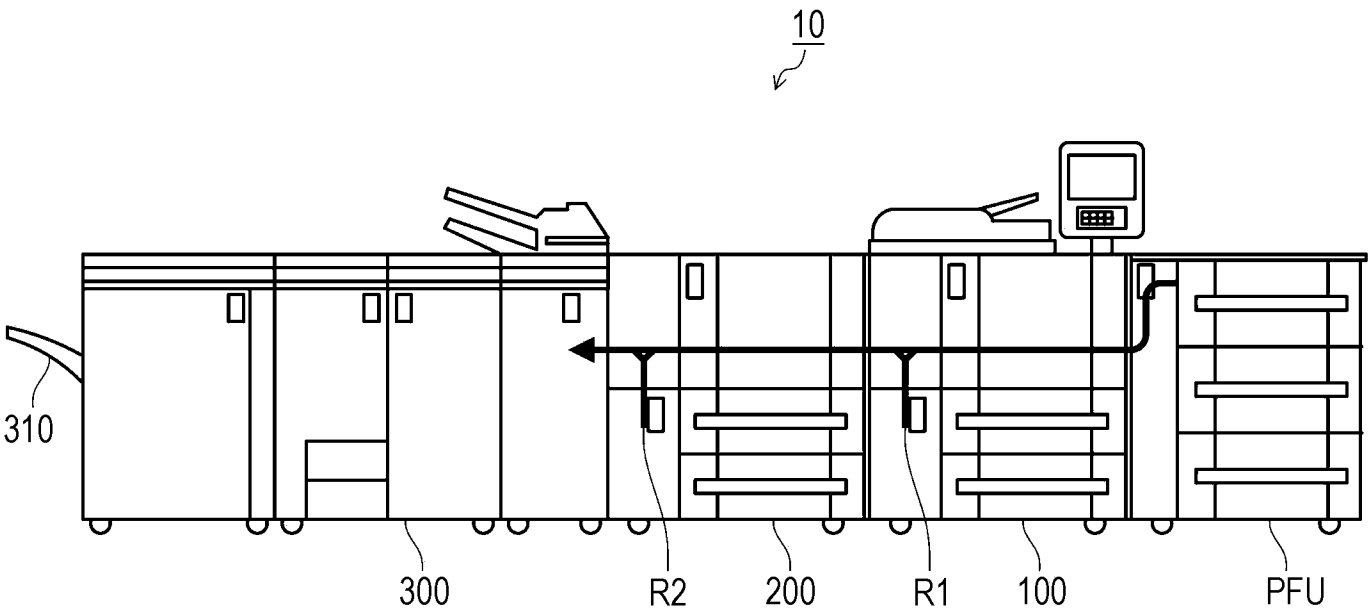
FIG. 1 is a diagram showing an overall configuration of an image forming system according to the present embodiment.

An image forming system 10 shown in FIG. 1 includes a paper feed tray unit PFU, a first image forming apparatus 100, a second image forming apparatus 200, a post-processing apparatus 300, etc. connected in this order. The first image forming apparatus 100 includes an inversion mechanism R1. The second image forming apparatus 200 includes an inversion mechanism R2. The post-processing apparatus 300 includes an output tray 310. An arrow in the figure indicates a paper transport path. A system including two or more image forming apparatuses connected in series like the image forming system 10 shown in FIG. 1 is generally called a tandem image forming system.

When performing double-sided printing, the image forming system 10 feeds paper from the paper feed tray unit PFU, and prints on the front side (a first side) of the paper by the first image forming apparatus 100. After that, the image forming system 10 inverts the paper by the inversion mechanism R1 and transports the paper to the second image forming apparatus 200. Then, the image forming system 10 prints on the back side (a second side) of the paper by the second image forming apparatus 200. After printing on the back side of the paper, the image forming system 10 inverts the paper by the inversion mechanism R2 and transports the inverted paper to the post-processing apparatus 300. When post-processing is required, the image forming system 10 performs post-processing such as multi-folding, saddle stitching, or side stitching on the paper by the post-processing apparatus 300. Finally, the image forming system 10 ejects the double-sided printed or post-processed paper to the output tray 310.

When performing single-sided printing, the image forming system 10 feeds paper from the paper feed tray unit PFU, performs single-sided printing in the first image forming apparatus 100, and performs only transport in the second image forming apparatus 200. Alternatively, the image forming system 10 feeds paper from the paper feed tray unit PFU, performs only transport in the first image forming apparatus 100 without printing, and performs single-sided printing in the second image forming apparatus 200.

For the sake of simplicity, assuming the former case, the flow of a printing process will be described. First, the image forming system 10 feeds paper from the paper feed tray unit PFU, and prints on the front side of the paper by the first image forming apparatus 100. After that, the image forming system 10 transports the paper to the second image forming apparatus 200. Then, the image forming system 10 passes the single-sided printed paper by the second image forming apparatus 200. When post-processing is required, the image forming system 10 performs post-processing and processing such as inversion on the single-sided printed paper by the post-processing apparatus 300. Finally, the image forming system 10 ejects the single-sided printed paper to the output tray 310.

The image forming system 10 can perform single-sided printing or double-sided printing in other various modes. Other single-sided or double-sided printing modes will be described later.

[Functional Configuration of Image Forming System 10]

Figure 2:
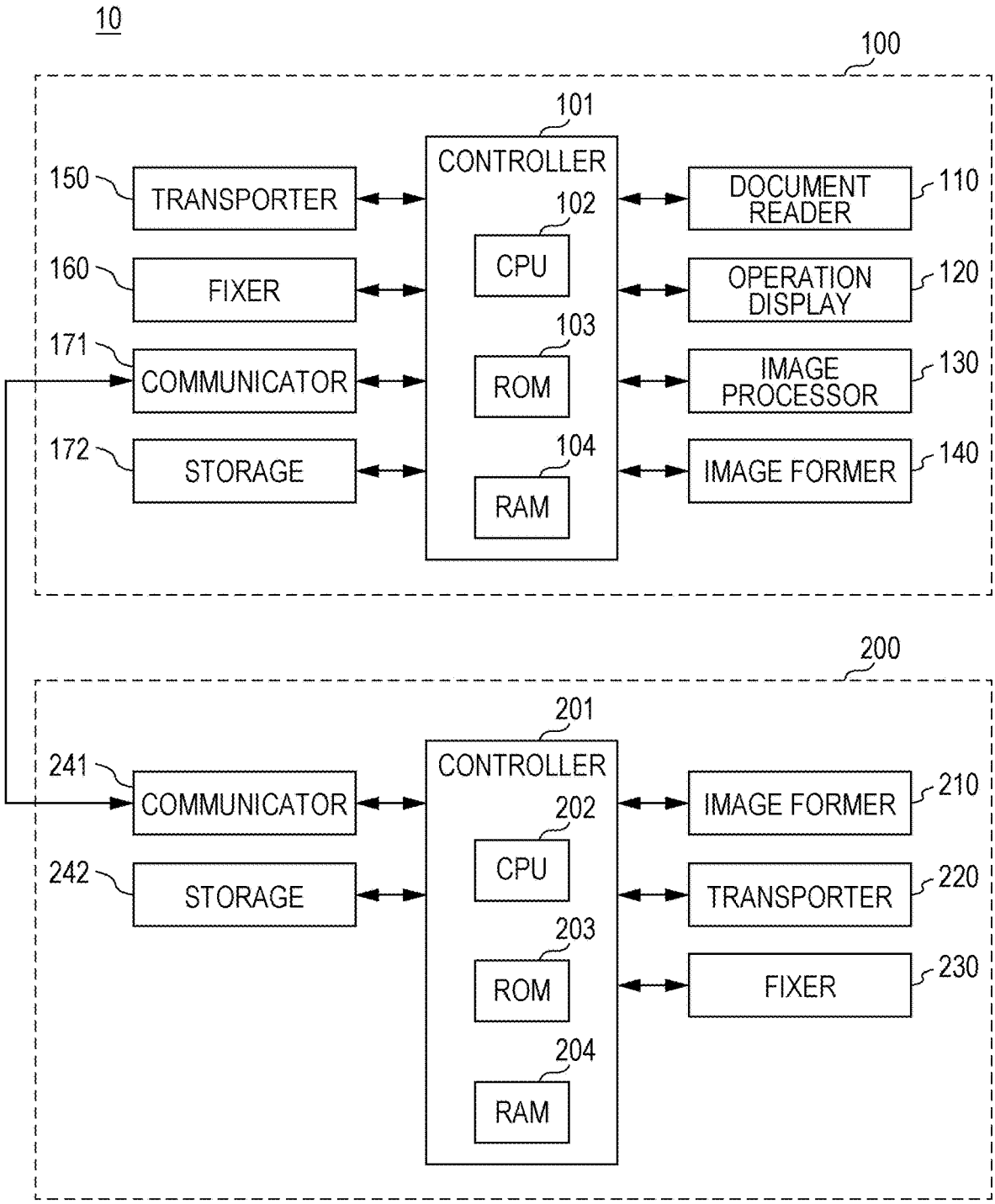
FIG. 2 is a functional block diagram of the image forming system.

Next, a functional configuration of the image forming system 10 will be described. As shown in FIG. 2, the image forming system 10 includes the first image forming apparatus 100 and the second image forming apparatus 200. In the image forming system 10 shown in FIG. 2, the paper feed tray unit PFU and the post-processing apparatus 300 are not shown.

The first image forming apparatus 100 includes a controller 101, a document reader 110, an operation display 120, an image processor 130, an image former 140, a transporter 150, a fixer 160 (first fixer), a communicator 171, and a storage 172.

The controller 101 includes a central processing unit (CPU) 102, read-only memory (ROM) 103, random-access memory (RAM) 104, etc.

The CPU 102 reads a program according to processing content from the ROM 103, develops it in the RAM 104, and controls the operation of each block of the first image forming apparatus 100 in cooperation with the developed program. At this time, various data stored in the storage 172 are referred to. The storage 172 includes, for example, nonvolatile semiconductor memory (so-called flash memory) or a hard disk drive.

The controller 101 transmits and receives various data to and from an external device (e.g. a personal computer) connected to a communication network such as a local-area network (LAN) or a wide-area network (WAN), via the communicator 171. The controller 101 receives, for example, image data transmitted from the external device, and forms an image on paper based on the image data (input image data). The communicator 171 includes, for example, a communication control card such as a LAN card.

In the present embodiment, the controller 101 transmits and receives various data to and from the second image forming apparatus 200 via the communicator 171. The controller 101 cooperates with a controller 201 of the second image forming apparatus 200 via the communicator 171, and also controls the operation of the second image forming apparatus 200.

The document reader 110 optically scans a document transported onto a contact glass, and forms an image of light reflected from the document on a light-receiving surface of a charge-coupled device (CCD) sensor to read the document. The transportation of a document onto the contact glass is performed by an automatic document feeder (ADF). In some cases, a document is manually placed on the contact glass.

The operation display 120 includes a touch panel screen. A user can perform input operation for various instructions and settings through the touch panel screen.

The image processor 130 includes a circuit that performs analog-to-digital (A/D) conversion processing and a circuit that performs digital image processing. The image processor 130 generates digital image data from an analog image signal acquired by the CCD sensor of the document reader 110 by the A/D conversion processing, and outputs it to the image former 140.

The image former 140 emits laser light based on the digital image data generated by the image processor 130, and irradiates a photoreceptor drum with the emitted laser light, thereby forming an electrostatic latent image on the photoreceptor drum (an exposure process).

In addition to the exposure process, the image former 140 includes a configuration to perform a charging process performed before the exposure process, a development process performed after the exposure process, a transfer process after the development process, and a cleaning process after the transfer process, individually.

In the charging process, the image former 140 uniformly charges the surface of the photoreceptor drum by corona discharge from a charging device. In the development process, the image former 140 forms a toner image on the photoreceptor drum by causing toner contained in a developer in a development device to adhere to the electrostatic latent image on the photoreceptor drum.

In the transfer process, the image former 140 transfers the toner image on the photoreceptor drum to paper transported by the transporter 150. In the cleaning process, the image former 140 removes toner remaining on the photoreceptor drum after the transfer process.

The fixer 160 applies heat and pressure to the toner image on the paper introduced into a fixing nip part (heat fixing), thereby fixing the toner image to the paper (fixing process). As a result, a fixed toner image is formed on the paper.

The second image forming apparatus 200 includes the controller 201, an image former 210, a transporter 220, a fixer 230 (second fixer), a communicator 241, and a storage 242. Processing of the individual units in the second image forming apparatus 200 is similar to processing of the controller 101, the image former 140, the transporter 150, the fixer 160, the communicator 171, and the storage 172 described in the first image forming apparatus 100, and thus will not be described here.

[Configurations of Image Formers 140 and 210 and Fixers 160 and 230]

Next, with reference to FIG. 3, the configurations of the image former 140 and the fixer 160 included in the first image forming apparatus 100, and the configurations of the image former 210 and the fixer 230 included in the second image forming apparatus 200 will be described.

The image former 140 of the first image forming apparatus 100 includes a photoreceptor drum 141, a charging device 142, an exposure device 143, a development device 144, a transfer transport path 145 that guides paper to a transfer region, a transfer belt 146 that transfers a toner image formed on the photoreceptor drum 141 to paper, and a cleaning device 147 that removes toner remaining on the photoreceptor drum 141. The charging device 142, the exposure device 143, the development device 144, the transfer transport path 145, the transfer belt 146, and the cleaning device 147 are provided along a rotation direction (arrow direction) of the photoreceptor drum 141. In the transfer transport path 145, a plurality of transport roller pairs 145*a* mainly consisting of a drive roller and a driven roller is disposed. Transport roller pairs 145*a* are also disposed in the transporter 150.

The transfer belt 146 is stretched between a driven roller 148*a* and a drive roller 148*b*, and is disposed below the photoreceptor drum 141 such that the surface of the transfer belt 146 contacts a part of the outer peripheral surface of the photoreceptor drum 141. That is, a transfer nip part NP as a transfer region is formed between the transfer belt 146 and the photoreceptor drum 141. Paper is transported while being pressed against the photoreceptor drum 141 by the transfer belt 146 at the transfer nip part NP.

A transfer roller 149 capable of applying a transfer voltage to the transfer belt 146 is disposed inside the transfer belt 146 in contact with a part of the outer peripheral surface of the photoreceptor drum 141. A voltage application unit (not shown) as a power source that applies the transfer voltage to the transfer belt 146 is connected to the transfer roller 149. The controller 101 controls voltage to be applied by the voltage application unit so that a predetermined current flows from the transfer roller 149 to the transfer belt 146. When the transfer voltage is applied to the transfer belt 146, a toner image on the photoreceptor drum 141 is transferred to paper in contact with the photoreceptor drum 141.

The fixer 160 is provided downstream of the transfer belt 146 in a paper transport direction, that is, downstream of the first image former 140 in a transport path. The fixer 160 includes a fixing roller 161 (first fixing member) maintained at a predetermined heating temperature by a built-in heat source such as a halogen heater, and a pressure roller 162 (first pressure member) pressed against the fixing roller 161.

The fixer 160 of the first image forming apparatus 100 has the function of fixing an image formed on paper (a recording medium) by the image former 140 (first image former) to the paper by applying heat and pressure to the paper, and corresponds to a "first fixer" of the present invention.

Specifically, the fixer 160 introduces paper into a fixing nip part NP1 (first fixing nip part) between the fixing roller 161 and the pressure roller 162, transports the paper while pinching it, thereby heat-fixing an unfixed toner image on the paper by the heat of the fixing roller 161.

The image former 210 of the second image forming apparatus 200 includes a photoreceptor drum 211, a charging device 212, an exposure device 213, a development device 214, a transfer transport path 215 that guides paper to a transfer region, a transfer belt 216 that transfers a toner image formed on the photoreceptor drum 211 to paper, and a cleaning device 217 that removes toner remaining on the photoreceptor drum 211. The charging device 212, the exposure device 213, the development device 214, the transfer transport path 215, the transfer belt 216, and the cleaning device 217 are provided along a rotation direction (arrow direction) of the photoreceptor drum 211. In the transfer transport path 215, a plurality of transport roller pairs 215*a* mainly consisting of a drive roller and a driven roller is disposed. Transport roller pairs 215*a* are also disposed in the transporter 220.

The transfer belt 216 is stretched between a driven roller 218*a* and a drive roller 218*b*, and is disposed below the photoreceptor drum 211 such that the surface of the transfer belt 216 contacts a part of the outer peripheral surface of the photoreceptor drum 211. That is, a transfer nip part NP as a transfer region is formed between the transfer belt 216 and the photoreceptor drum 211. Paper is transported while being pressed against the photoreceptor drum 211 by the transfer belt 216 at the transfer nip part NP.

A transfer roller 219 capable of applying a transfer voltage to the transfer belt 216 is disposed inside the transfer belt 216 in contact with a part of the outer peripheral surface of the photoreceptor drum 211. A voltage application unit (not shown) as a power source that applies the transfer voltage to the transfer belt 216 is connected to the transfer roller 219. The controller 201 controls voltage to be applied by the voltage application unit so that a predetermined current flows from the transfer roller 219 to the transfer belt 216. When the transfer voltage is applied to the transfer belt 216, a toner image on the photoreceptor drum 211 is transferred to paper in contact with the photoreceptor drum 211.

The fixer 230 is provided downstream of the transfer belt 216 in a paper transport direction, that is, downstream of the second image former 210 in a transport path. The fixer 230 includes a fixing roller 231 (second fixing member) maintained at a predetermined heating temperature by a built-in heat source such as a halogen heater, and a pressure roller 232 (second pressure member) pressed against the fixing roller 231.

The fixer 230 of the second image forming apparatus 200 has the function of fixing an image formed on paper (a recording medium) by the image former 210 (second image former) to the paper by applying heat and pressure to the paper, and corresponds to a "second fixer" of the present invention.

Specifically, the fixer 230 introduces paper into a fixing nip part NP1 (second fixing nip part) between the fixing roller 231 and the pressure roller 232, transports the paper while pinching it, thereby heat-fixing an unfixed toner image on the paper by the heat of the fixing roller 231.

[Configurations of Inversion Transporters]

Next, with reference to FIG. 3, the configurations of inversion transporters provided in the image forming system 10 for reversing the front and back sides of paper will be described. In FIG. 3, transport directions of paper transported along individual transport paths are indicated by arrows. For the sake of simplicity, the inversion mechanism R2 (see FIG. 1) is not shown in FIG. 3.

In the image forming system 10, as configurations for performing mainly double-sided printing, inversion transporters that invert paper in position (the front and back sides and the front and rear edges in the transport direction) are provided in three places.

Figure 3:
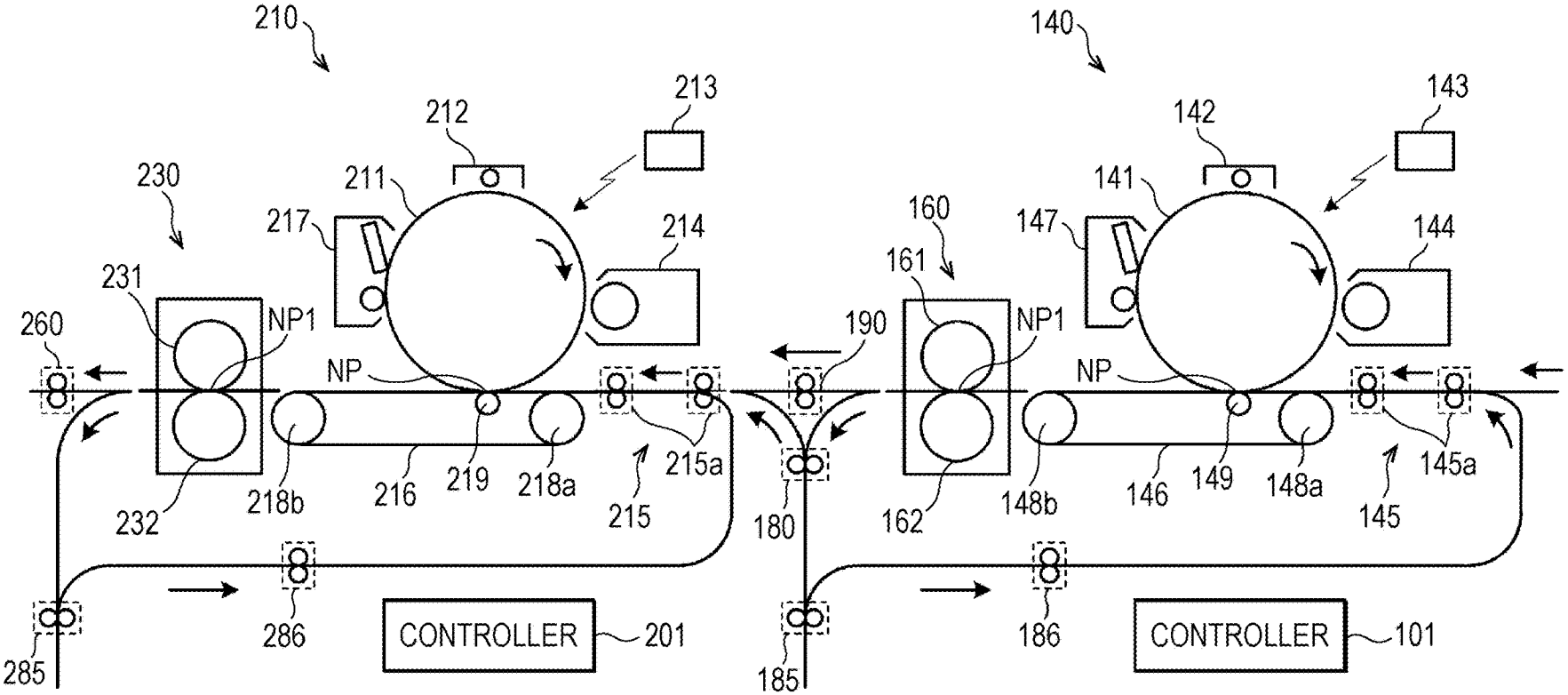
FIG. 3 is a diagram illustrating image formers, fixers, and paper transport paths in the image forming system.

That is, as shown in FIG. 3, the image forming system 10 includes a first inversion transporter in which a first inversion roller 180 is disposed to reverse the front and back sides of paper ejected from the first image forming apparatus 100 and provide it to the second image forming apparatus 200. The first inversion transporter corresponds to the inversion mechanism R1 described above with reference to FIG. 1.

Specifically, the first inversion transporter includes a branch transport path branching off from a paper ejection path (hereinafter referred to as a "straight transport path") in which a paper ejection roller 190 is disposed, for guiding paper downward, a merging transport path connected to the branch transport path for allowing paper to merge into the transfer transport path 215 of the second image forming apparatus 200, and the first inversion roller 180 as a switchback roller disposed between the branch transport path and the merging transport path.

Under the control of the controller 101, the first inversion transporter reverses the front and back sides of paper by performing the following operation, and delivers the paper to the transfer transport path 215 of the second image forming apparatus 200 (the transport roller pairs 215*a*).

First, paper sent to the branch transport path through a switching gate (not shown) is transported by the first inversion roller 180 rotating in the forward direction, thereby moving below the branch transport path.

Next, at a timing before the rear edge of the paper in the transport direction comes out of the nip of the first inversion roller 180, the orientation of the switching gate (not shown) and the rotation direction of the first inversion roller 180 are switched under the control of the controller 101 to transport the paper upward along the merging transport path.

By this operation (switchback transport operation), the paper is inverted both in the front and rear edges in the transport direction and in the front and back sides, and is supplied to the transfer transport path 215 of the second image forming apparatus 200. After that, on the paper, image formation is performed on a second side that is the upper side by the transfer nip part NP of the second image forming apparatus 200.

Thus, the first inversion transporter (inversion mechanism R1) has the function of reversing the front and back sides of paper (a recording medium) that has passed through the fixer 160 (first fixer) and supplying it to the second image forming apparatus 200, and corresponds to an "inter-apparatus medium inversion part" of the present invention.

In the example shown in FIG. 3, the straight transport path including the paper ejection roller 190 and the first inversion transporter including the first inversion roller 180 are disposed in the first image forming apparatus 100.

On the other hand, the disposition of the first inversion transporter is not limited to the example shown in FIG. 3, and it may be disposed on the inlet side in the second image forming apparatus 200. Alternatively, the first inversion transporter may be disposed (interposed) as a separate, independent device (inversion unit) between an outlet of the first image forming apparatus 100 and an inlet of the second image forming apparatus 200.

Further, in the present embodiment, a second inversion transporter in which a second inversion roller 185 and a transport roller 186 are disposed is provided to perform double-sided printing (image formation on the first side and the second side of paper) in the first image forming apparatus 100. The second inversion roller 185 and the transport roller 186 in the second inversion transporter correspond to an "inversion part" of the first image forming apparatus in the present invention.

The second inversion roller 185 and the transport roller 186 are disposed in a transport path (inversion transport path) for transporting paper that has passed through the fixer 160 (first fixer) back to a path on the inlet side of the first image forming apparatus 100 (the transfer transport path 145 in this example).

Further, in the present embodiment, a third inversion transporter in which a third inversion roller 285 and a transport roller 286 are disposed is provided to perform double-sided printing (image formation on the first side and the second side of paper) in the second image forming apparatus 200. The third inversion roller 285 and the transport roller 286 in the third inversion transporter correspond to an "inversion part" of the second image forming apparatus in the present invention.

The third inversion roller 285 and the transport roller 286 are disposed in a transport path (inversion transport path) for transporting paper that has passed through the fixer 230 (second fixer) back to a path on the inlet side of the second image forming apparatus 200 (the transfer transport path 215 in this example).

The second inversion roller 185 and the third inversion roller 285 each function as a switchback roller that, like the above-mentioned first inversion roller 180, switches the rotation direction to forward/reverse, thereby switching back the paper transport direction (the front and rear edges).

That is, as described above, paper that is inverted and transported by the first inversion roller 180 and supplied to the second image forming apparatus 200 is inverted in the front and back sides of the paper, and the rear edge in the transport direction up to that time becomes the front edge in the transport direction.

Then, the inversion or reversal of the position (the front and back sides and the traveling direction) of the paper also occurs in a process of switching the rotation direction of the second inversion roller 185 (third inversion roller 285) to forward/reverse.

Specifically, as shown in FIG. 3, the second inversion transporter includes a second branch transport path that branches off from below the branch transport path in which the above-mentioned first inversion roller 180 is disposed (hereinafter referred to as a "first branch transport path" for convenience), and guides paper to the front side of the transfer nip part NP, the transport roller 186 disposed in the second branch transport path, and the second inversion roller 185 (switchback roller) disposed in a position where the first branch transport path and the second branch transport path branch off.

Under the control of the controller 101, the second inversion transporter reverses the front and back sides of paper by performing the following operation, and delivers the paper to the transfer transport path 145 of the first image forming apparatus 100.

First, paper sent to the above-mentioned branch transport path (hereinafter referred to as the "first branch transport path" for convenience) through the switching gate (not shown) is transported by the first inversion roller 180 rotating in the forward direction, thereby moving below the branch transport path.

At this time, the second inversion roller 185 is also rotating in the forward direction, and the second inversion roller 185 transports the paper that has been transported by the first inversion roller 180 further downward.

Next, at a timing before the rear edge of the paper in the transport direction comes out of the nip of the second inversion roller 185, the orientation of the switching gate (not shown) and the rotation direction of the second inversion roller 185 are switched under the control of the controller 101 to transport the paper upward and deliver the paper to the transport roller 186 in the second branch transport path.

Based on this operation (switchback transport operation), the paper is inverted both in the front and rear edges in the transport direction and in the front and back sides, and is supplied to the transfer transport path 145 of the first image forming apparatus 100 (that is, the upstream side of the transfer nip part NP). After that, on the paper, image formation is performed on the second side that is the upper side by the transfer nip part NP of the first image forming apparatus 100.

Furthermore, as shown in FIG. 3, the third inversion transporter includes a fourth branch transport path that branches off from below a branch transport path (hereinafter referred to as a "third branch transport path" for convenience) branching off from a paper ejection path (straight transport path) in which a paper ejection roller 260 is disposed for guiding paper downward, and guides paper to the front side of the transfer nip part NP, the transport roller 286 disposed in the fourth branch transport path, and the third inversion roller 285 (switchback roller) disposed in a position where the third branch transport path and the fourth branch transport path branch off.

Under the control of the controller 201, the third inversion transporter reverses the front and back sides of paper by performing the following operation, and delivers the paper to the transfer transport path 215 of the second image forming apparatus 200.

First, paper sent to the above-mentioned third branch transport path through a switching gate (not shown) is delivered to the third inversion roller 285 rotating in the forward direction, thereby moving below the third branch transport path.

Next, at a timing before the rear edge of the paper in the transport direction comes out of the nip of the third inversion roller 285, the orientation of the switching gate (not shown) and the rotation direction of the third inversion roller 285 are switched under the control of the controller 201 to transport the paper upward and deliver the paper to the transport roller 286 in the fourth branch transport path.

By this operation (switchback transport operation), the paper is inverted both in the front and rear edges in the transport direction and in the front and back sides, and is supplied to the transfer transport path 215 of the second image forming apparatus 200 (the upstream side of the transfer nip part NP). After that, on the paper, image formation is performed on the upper side by the transfer nip part NP of the second image forming apparatus 200.

Hereinafter, for convenience of explanation, a state in which the front and back sides and the traveling direction of paper are reversed by a forward/reverse rotation (switchback) operation of any of the inversion rollers (180, 185, and 285) is also referred to as "position inversion".

Figure 4A:
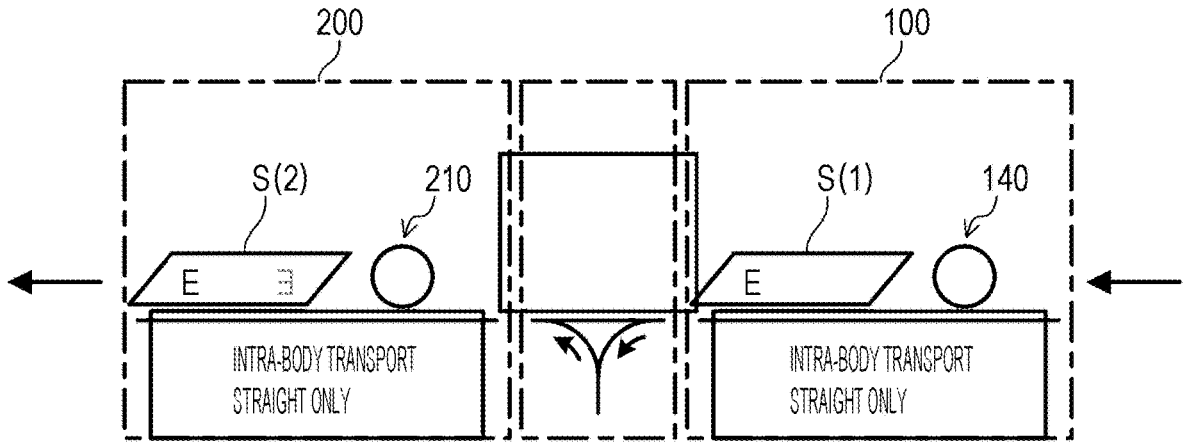
FIG. 4A and FIG. 4B are diagrams illustrating cases where the position (the sides and the front and rear edges) of paper sent into individual fusers is changed when double-sided printing is performed using a normal transport path.
Figure 4B:
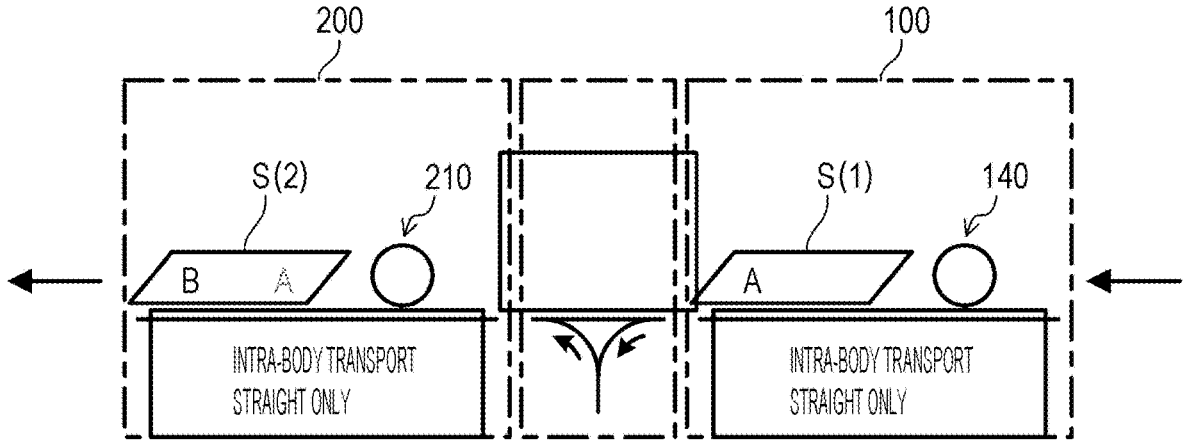

In the present embodiment, such a configuration including a plurality of inversion transporters allows various types of printing as illustrated in FIG. 4A and FIG. 4B and subsequent figures.

For ease of understanding, in the diagrams of and after FIG. 4A, the illustration of the above-described internal configurations of the first and second image forming apparatuses 100 and 200 is omitted as appropriate. In the diagrams of and after FIG. 4A, the reference numeral "S (1)" indicates that the first side of paper is the upper side, and the reference numeral "S (2)" indicates that the second side of the paper is the upper side.

Here, the "first side" of paper means the upper side of the paper when the paper is first supplied (fed) to the first image forming apparatus 100.

FIG. 4A and FIG. 4B are diagrams illustrating cases of performing double-sided printing using only the above-mentioned first inversion transporter (see the first inversion roller 180 etc. in FIG. 3).

Specifically, the case shown in FIG. 4A is an example where text (indicated by "E" in the figure) is printed on the first side of paper by the first image forming apparatus 100, the paper is inverted in position through the first inversion transporter, and different text (indicated by "E" in the figure) is printed on the second side of the paper by the second image forming apparatus 200 before ejection. Such double-sided printing is preferably used, for example, when pages other than a cover are printed at the time of bookbinding.

On the other hand, the case shown in FIG. 4B is an example where letters etc. (indicated by "A" in the figure) are printed on the first side of paper by the first image forming apparatus 100, the paper is inverted in position through the first inversion transporter, and letters etc. (indicated by "B" in the figure) are printed in another color (e.g. red) on the second side of the paper by the second image forming apparatus 200 before ejection.

Thus, the image forming system 10 allows a user to perform setting of printing using a plurality of monochromatic machines (the image forming apparatuses 100 and 200) on the single operation display 120 (see FIG. 2), to perform double-sided printing in modes illustrated in FIG. 4A and FIG. 4B.

Figure 5A:
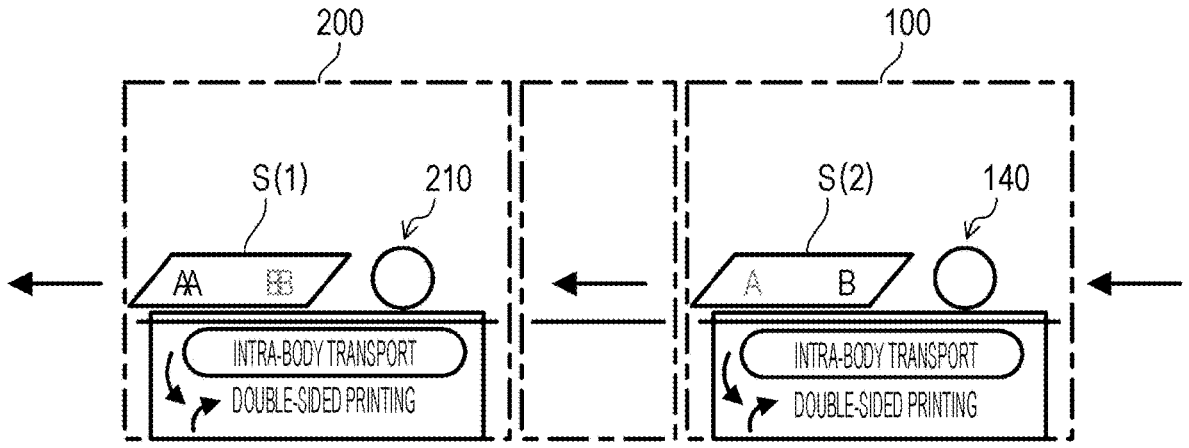
FIG. 5A and FIG. 5B are diagrams illustrating cases where the position of paper processed by the individual fusers is the same when a normal transport path is used.
Figure 5B:
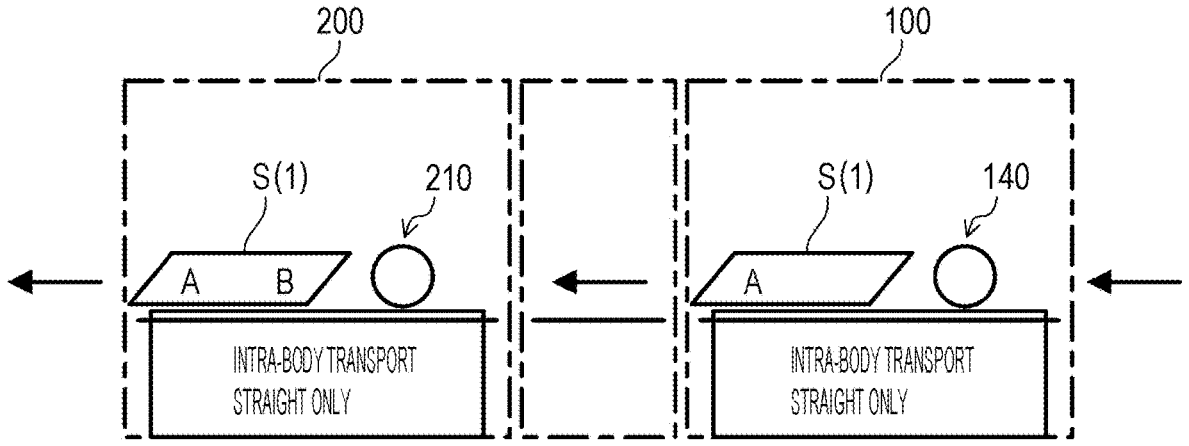

On the other hand, in the tandem image forming system 10 like this, depending on the content of a print job, damage (such as wrinkles or curl) can occur to paper as illustrated in FIG. 5A and FIG. 5B.

Here, FIG. 5A and FIG. 5B are diagrams illustrating cases where the position (both the sides and the front and rear edges) of paper is not changed when the paper is supplied from the first image forming apparatus 100 to the second image forming apparatus 200.

Specifically, FIG. 5A shows the case where paper is double-sided printed by the first image forming apparatus 100, is directly fed with the second side up into the second image forming apparatus 200, and is also double-sided printed by the second image forming apparatus 200 and ejected.

In FIG. 5A, the paper shown in the first image forming apparatus 100 is in a state after an image "A" has been printed on the first side, then the position has been inverted through the above-mentioned second inversion transporter, and further an image "B" has been printed on the second side, and before the paper is sent to the second image forming apparatus 200 with the second side up.

In FIG. 5A, the paper shown in the second image forming apparatus 200 shows a state after an image "B" has been printed on the second side by the second image forming apparatus 200, then the position has been inverted through the above-mentioned third inversion transporter, and further an image "A" has been printed on the first side, and before the paper is ejected with the first side up.

On the other hand, FIG. 5B shows the case where an image "A" is printed on the first side of paper by the first image forming apparatus 100, and after the single-sided printing, the paper is directly fed with the first side up into the second image forming apparatus 200, and an image "B" is printed on the first side of the paper by the second image forming apparatus 200 before ejection.

In either case, the position of the paper is not changed between a final fixing process performed in the first image forming apparatus 100 (that is, the paper passing through the fixer 160 immediately before being sent to the second image forming apparatus 200) and a fixing process performed first in the second image forming apparatus 200.

However, there is a problem that when fixing processes are performed continuously with the position of paper remaining the same like this, the heat and pressure of the rollers in the fixing nip parts NP1 and further the roller shape (the shape in which the peripheral speed in the center in the width direction is slow) etc. are likely to cause damage to the paper, typically wrinkles extending along the paper transport direction or large curl in the paper transport direction.

A case where damage such as wrinkles or large curl occurs to paper as described above is likely to occur particularly when a recording medium used is thin paper.

On the other hand, it has been found that when printing is completed by a single machine, that is, the first image forming apparatus 100 (or the second image forming apparatus 200) alone, the problem that a recording medium is damaged as described above does not occur at all or hardly occurs even in cases where thin paper is repeatedly double-sided printed.

It is considered that the reason why paper is not damaged when printing is completed by one image forming apparatus is as follows.

For example, assume a case where double-sided printing is repeatedly performed on a sheet of paper (thin paper) only by the first image forming apparatus 100, and the paper is ejected without being passed through the second image forming apparatus 200.

In this case, in each printing process (on the top side of the paper) by the image former 140 and the fixer 160, an operation to reverse the position of the paper is performed through the above-mentioned second inversion transporter (see the second inversion roller 185 etc. in FIG. 3).

As a result, no matter how many times the paper passes through the fixer 160 at which pressure and heat are applied, the position (the sides and the front and rear edges) in which the paper enters the fixing nip part NP1 is changed each time. Compared to cases where the position in which paper enters the fixing nip part NP1 is the same each time, the paper is much less likely to be curled or wrinkled, for example.

From another point of view, in cases where the position (the sides and the front and rear edges) of paper passing through the fixing nip part NP1 is the same each time, slight distortion, crease, or the like in the paper caused by the heat and pressure of the fixing nip part NP1 accumulates each time, and thus eventually appears as damage such as curl or wrinkles affecting the quality even when the paper is not thin.

On the other hand, when the position (the sides and the front and rear edges) of paper passing through the fixing nip part NP1 is changed each time, slight distortion, crease, or the like in the paper produced during a previous image formation process is corrected or recovered each time the paper passes through the fixing nip part NP1, so that damage is less likely to accumulate. As a result, the above-mentioned damage is less likely to appear even in thin paper.

Based on the above-described findings, in the present embodiment, in a case where the image formation and fixing processes are performed two or more times, it is determined whether or not the position of paper is the same between the nth fixing process and the (n+1)th fixing process when the paper is transported in the normal transport path. If it is the same, control is performed to change the position of the paper.

Of the above description, the "normal transport path" is, for example, a transport path that maximizes printing productivity, and generally corresponds to a path in which the length along which paper is transported (total path length) is shorter.

The control to "change the position of the paper" may be, for example, setting and transport control to increase inversion transport using the above-mentioned inversion transporters. As additional control, control to change the sequence of printing print pages (page images) may be performed.

When paper transport control is performed so as to increase inversion transport using the inversion transporters, the printing productivity is generally disadvantageously reduced as compared with cases where paper transport control is performed using the normal transport path. Therefore, in the present embodiment, such control is selectively or exceptionally performed according to image formation conditions.

Here, the image formation conditions include, for example, a printing method of the first image forming apparatus 100 and the second image forming apparatus 200 based on the content of a print job (whether it is single-sided printing or double-sided printing), the basis weight of paper (whether it is thin paper or not), and user setting information, and in addition, may include various conditions (information) such as temperature and humidity information around the apparatuses.

As a more specific configuration example, when executing a print job, the controller 101 of the first image forming apparatus 100 determines or specifies (so to speak, temporarily sets) a transport path through which to transport paper (normal transport path) from the content of the print job, and acquires paper information on paper to be used. Control content of the controller 101 to perform transport control using the above-mentioned "normal transport path" corresponds to "first transport control content" of the present invention.

Then, the controller 101 determines whether or not there is a possibility that the paper may be damaged (wrinkled or curled, for example) when the paper is transported over the temporarily set normal transport path. If it is determined as YES, the controller 101 performs processing to change the specified or temporarily set transport path (so to speak, construct or reset a new transport path).

At this time, the controller 101 controls to set a new transport path (so to speak, a damage prevention path) so that the position (the print side and the front and rear edges) of the paper is changed between the nth fixing process and the (n+1)th fixing process in the print job, and transport the paper along the set path.

As another specific example, the controller 101 performs the above-mentioned processing such as determination and reconstruction (resetting) of a new transport path only when the user setting information is not set to a "productivity priority mode".

In the above example, the controller 101 corresponds to a "setting unit" and a "transport controller" of the present invention. Control content of the controller 101 to perform transport control using a set new transport path (damage prevention path) corresponds to "second transport control content" of the present invention.

Hereinafter, with reference to FIG. 6A to FIG. 9B, specific cases where problems occur and control examples for them will be described. In order to facilitate understanding of the operation of each unit, the position of paper, etc., a table is shown on the right side in each figure illustrated below.

In the table, the distinction between the first image forming apparatus 100 and the second image forming apparatus 200 in a "printing apparatus" column is indicated by the terms "upstream machine" and "downstream machine", respectively. The distinction between the first side and the second side of paper in a "print side/printing sequence" column is indicated by the terms "side 1" and "side 2", respectively.

An "entering edge" column in the table indicates the edge of paper on the side that enters the fuser of the corresponding printing apparatus (that is, the first image forming apparatus 100 or the second image forming apparatus 200). A "rear edge" represents the rear edge of paper in an initial stage of transportation, that is, at the time of being supplied to the first image forming apparatus 100.

Figure 6A:
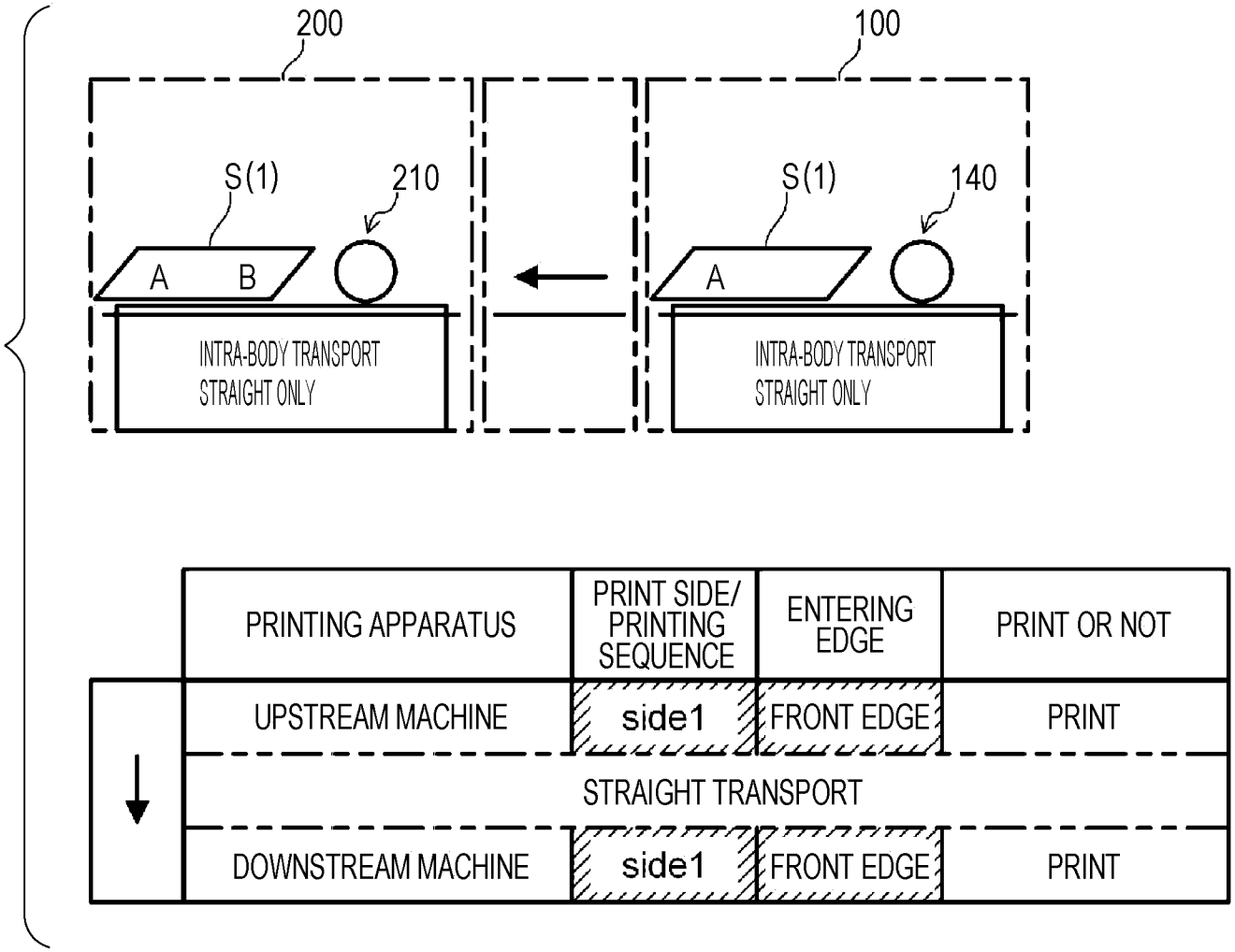
FIG. 6A is a diagram illustrating the transport path in the case illustrated in FIG. 5B.
Figure 6B:
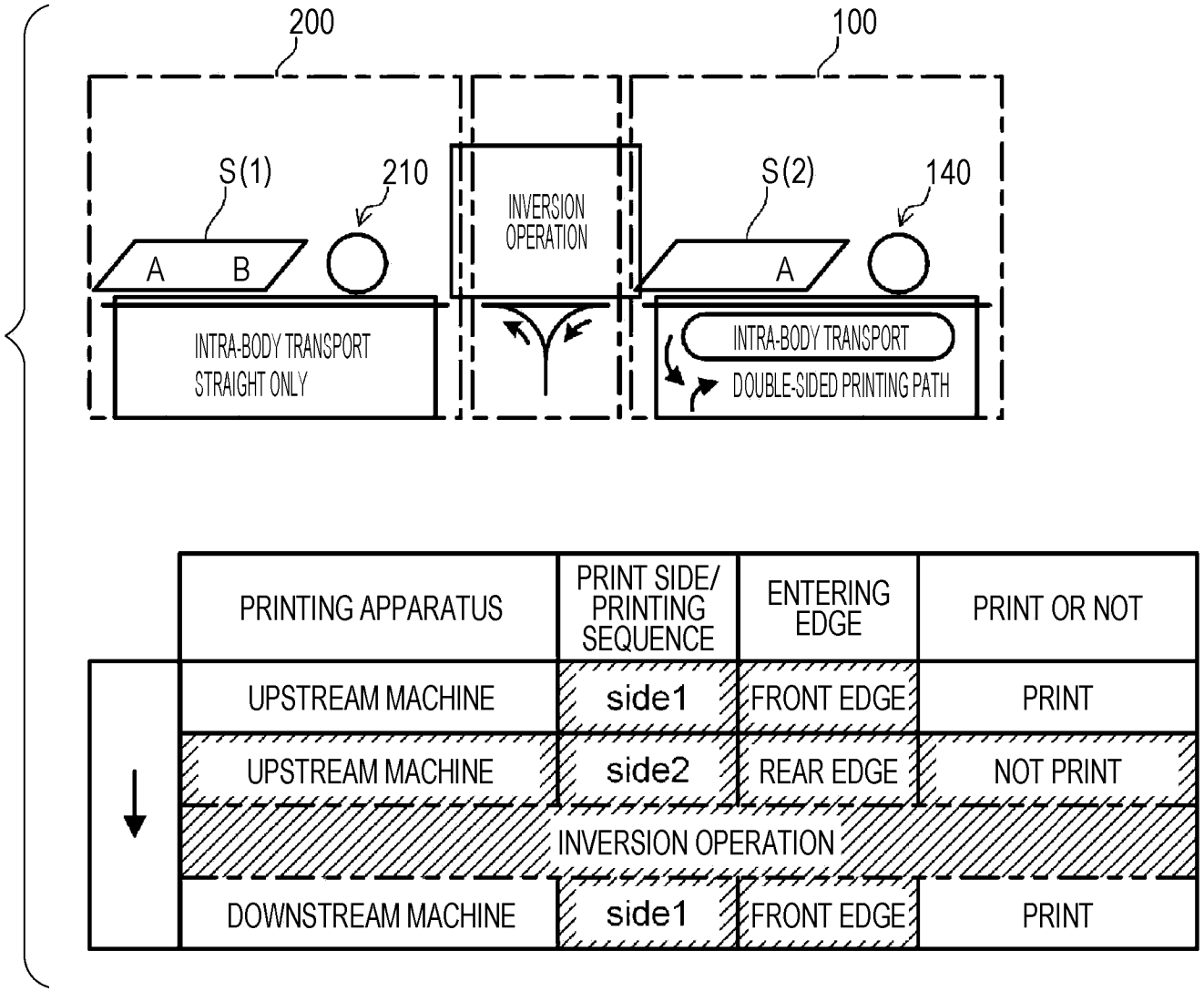
FIG. 6B and FIG. 6C are diagrams illustrating path setting and transport control to prevent the position (the sides and the front and rear edges) of paper from being continuously the same in a print job illustrated in FIG. 5B.
Figure 6C:
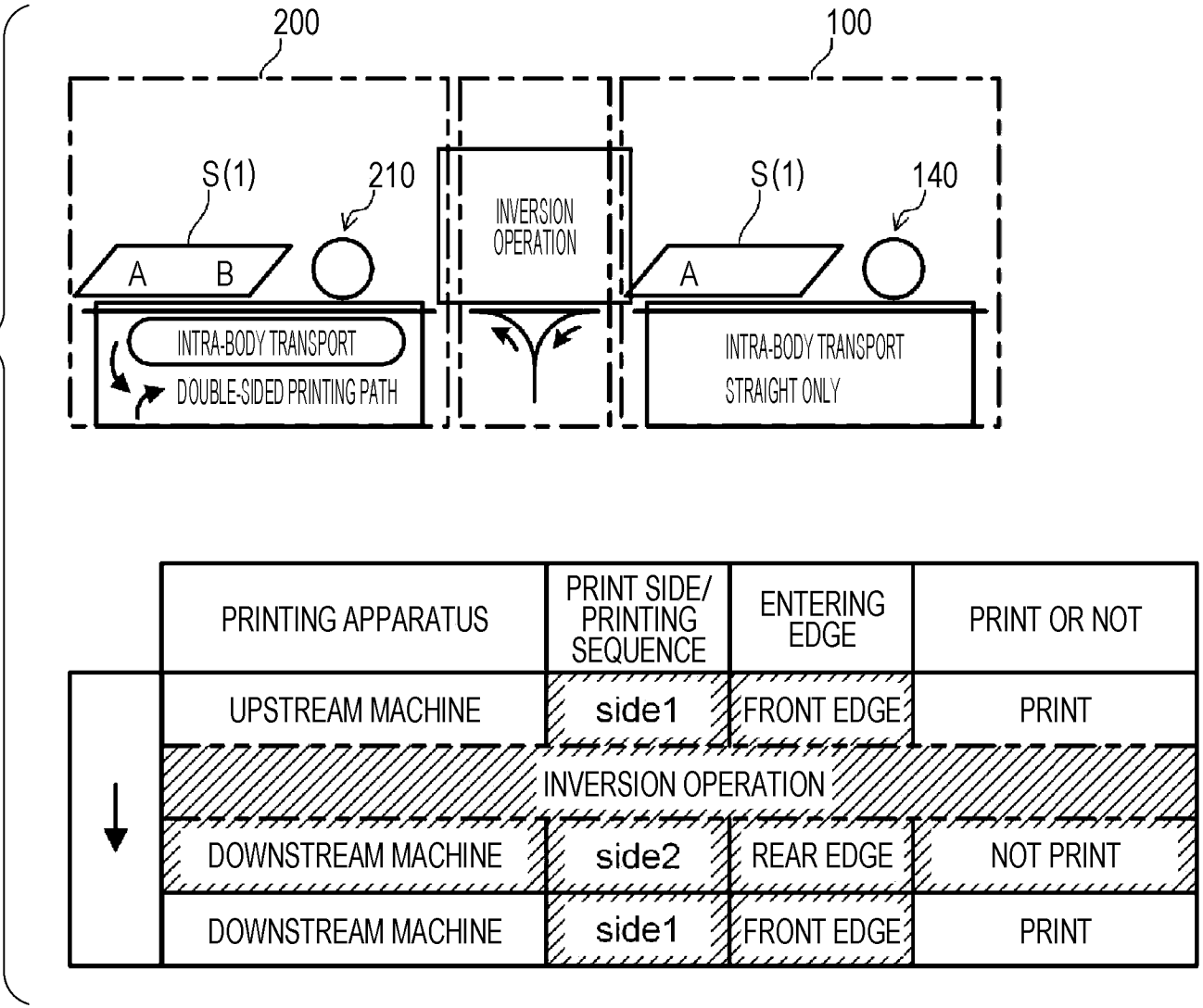

FIG. 6A is a diagram showing the case illustrated in FIG. 5B again and illustrating an operation, the position of paper, etc. FIG. 6B and FIG. 6C are diagrams illustrating control methods to prevent the position (the sides and the front and rear edges) of paper from being continuously the same in the print job illustrated in FIG. 5B. As shown by a downward arrow in the left column of each table, the table shows the traveling direction of paper from the upper part (upstream machine side) to the lower part (downstream machine side).

As shown in the table in FIG. 6A, in the case illustrated in FIG. 5B, both the first image forming apparatus 100 and the second image forming apparatus 200 perform printing only on the first side of paper ("side 1" in the table. The same applies hereinafter).

In this case, transport of paper without using any inversion transporter is advantageous in terms of productivity etc., and thus such paper transport control has been performed. However, such control has a problem that damage to paper as described above is likely to occur, particularly when the paper is thin.

Therefore, in the present embodiment, as shown in FIG. 6B (or FIG. 6C), the controller 101 changes or resets the transport path (in other words, changes the transport control content).

Here, FIG. 6B shows a control example where an image "A" is printed on the first side of paper by the first image forming apparatus 100, then the paper is inverted by the inversion transporter (second inversion transporter) in the first image forming apparatus 100 and is sent into the fuser (second entry), and the inverted paper is further inverted by the first inversion transporter and supplied to the second image forming apparatus 200.

By this transport control, as in the case of FIG. 6A, the entering edge of the paper that enters the fixer 230 of the second image forming apparatus 200 becomes the paper "front edge". However, it is different in that this is the "third" entry, and the second entry is by the paper "rear edge".

In other words, as can be seen by comparing the "entering edge" columns in the tables of FIG. 6A and FIG. 6B, the transport control (second transport control content) of the present embodiment avoids continuous entry of the same edge by utilizing the change of the paper position and the number of entries into the fixer 160 increased by one when inversion transport of the paper is performed once.

As another specific example of the present embodiment, FIG. 6C shows a control example where the number of entries into the fixer 230 is increased by one on the second image forming apparatus 200 side.

Specifically, in the example shown in FIG. 6C, the first image forming apparatus 100 prints on the first side of paper, and then the paper is inverted through the first inversion transporter and supplied to the second image forming apparatus 200. After that, the second image forming apparatus 200 sends the paper into the fuser (second entry) without printing on the second side of the paper, and after that, inverts the paper through the third inversion transporter, and then prints on the first side of the paper and sends it into the fuser (third entry).

By this transport control, processing different from that in the case of FIG. 6A is performed. For example, unlike the case of FIG. 6A, the second entering edge of the paper that enters the fixer 230 (fixing nip part NP1) of the second image forming apparatus 200 becomes the paper "rear edge", and at this time, printing is not performed by the second image forming apparatus 200.

In either case of FIG. 6B or FIG. 6C, the present embodiment can effectively prevent the occurrence of damage to paper without adding a configuration for correcting curl, wrinkles, or the like, thus ensuring the quality of printed matter.

The control content (second transport control content) illustrated in FIG. 6B or FIG. 6C can be used properly as follows to enjoy further advantages.

For example, when the first image forming apparatus 100 and the second image forming apparatus 200 have substantially the same configuration as in the present embodiment, the control shown in FIG. 6B and the control shown in FIG. 6C are performed alternately so that the image forming apparatuses (100 and 200) perform double-sided printing the same number of times.

Such an operation allows the maintenance of the first image forming apparatus 100 and the second image forming apparatus 200 to be adjusted in cycle, that is, to be performed at the same time, resulting in a decrease in the frequency of maintenance.

Alternatively, if the in-machine temperature of the first image forming apparatus 100 is close to an upper limit of an operating condition at the time of execution of a print job, the control shown in FIG. 6C is performed without performing the control shown in FIG. 6B. On the other hand, in the opposite case, that is, if the in-machine temperature of the second image forming apparatus 200 is close to the upper limit of the operating condition, only the control shown in FIG. 6B is performed.

This is because, in general, passing paper through the inversion transport path during double-sided printing has the effect of raising the temperature inside the apparatus, and thus, in terms of ensuring productivity, it is desirable to perform double-sided printing in the image forming apparatus (200 or 100) that has a sufficiently low in-machine temperature.

Another case and solution will be described with reference to FIG. 7A and FIG. 7B.

Figure 7A:
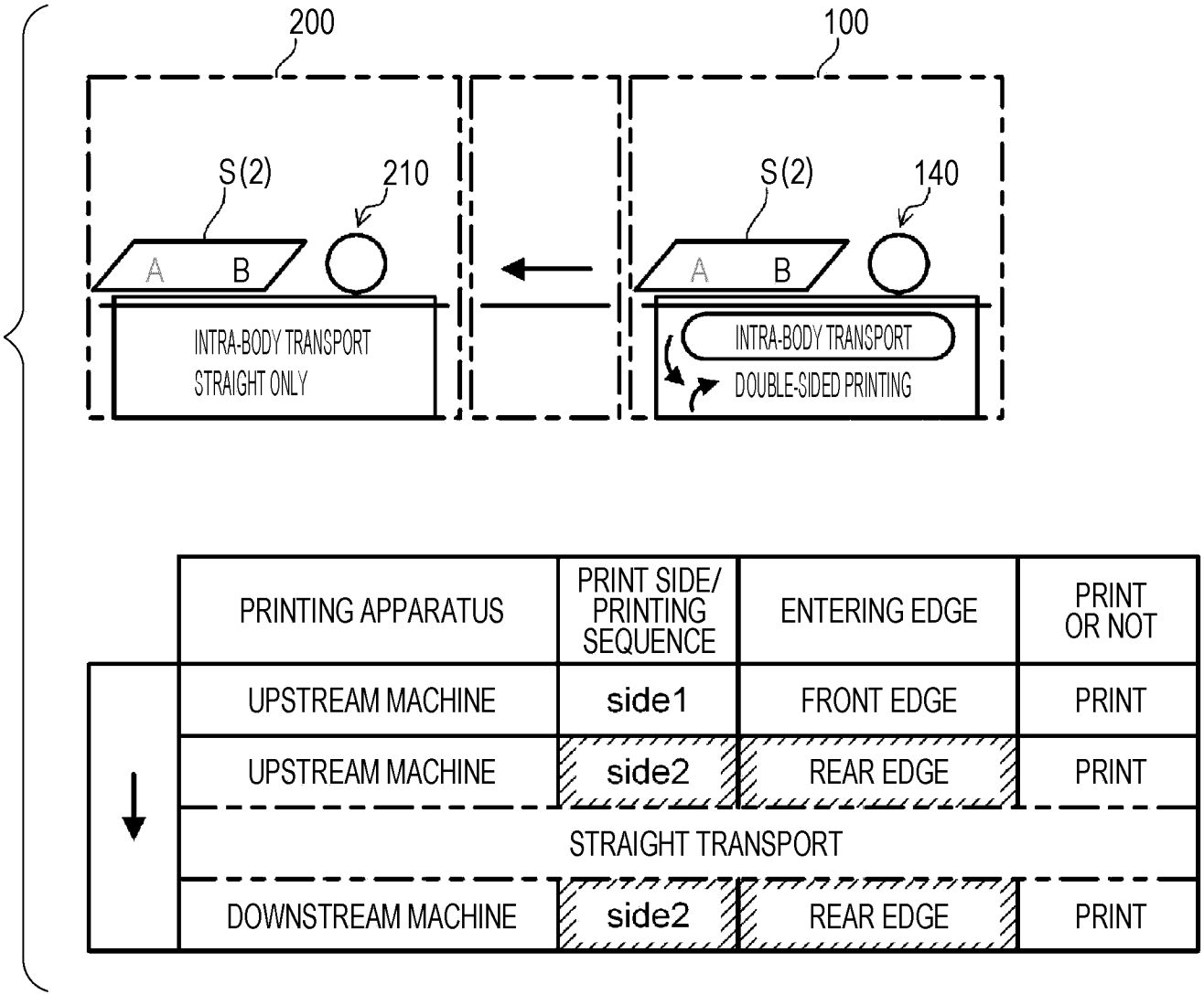
FIG. 7A is a diagram illustrating a case where the position of paper entering the fusers is continuously the same.

Here, FIG. 7A is a diagram illustrating an operation, the position of paper, etc. in another print job that can cause damage to paper, in other words, a diagram showing the "first transport control content" in the present invention. On the other hand, FIG. 7B is a diagram illustrating a control method to prevent the position (the sides and the front and rear edges) of paper from being continuously the same in the print job illustrated in FIG. 7A, in other words, a diagram showing the "second transport control content" in the present invention.

In the case shown in FIG. 7A, the first image forming apparatus 100 double-sided prints an image "A" on the first side of paper and an image "B" on the second side, and the second image forming apparatus 200 prints an image "B" of a different color only on the second side (side 2) of the paper (see paper S (2) shown in FIG. 7A).

In this case, it is advantageous in terms of productivity etc. that on the paper ejected from the first image forming apparatus 100 with the second side (side 2) up and sent to the second image forming apparatus 200, printing is performed with the position unchanged, and thus such paper transport control has been performed.

However, such control results in the second entering edge being the same as the third entering edge (in this case, the rear edge) as shown in the "entering edge" column of the table. Thus, there is a problem that damage to paper is likely to occur especially when the paper is thin as described above.

Therefore, in the present embodiment, an inversion operation is performed by the above-mentioned first inversion roller 180 (inter-apparatus medium inversion part) to change the third entering edge in the downstream machine to the "front edge", and printing itself is performed after the paper is inverted again through the third inversion transporter.

Figure 7B:
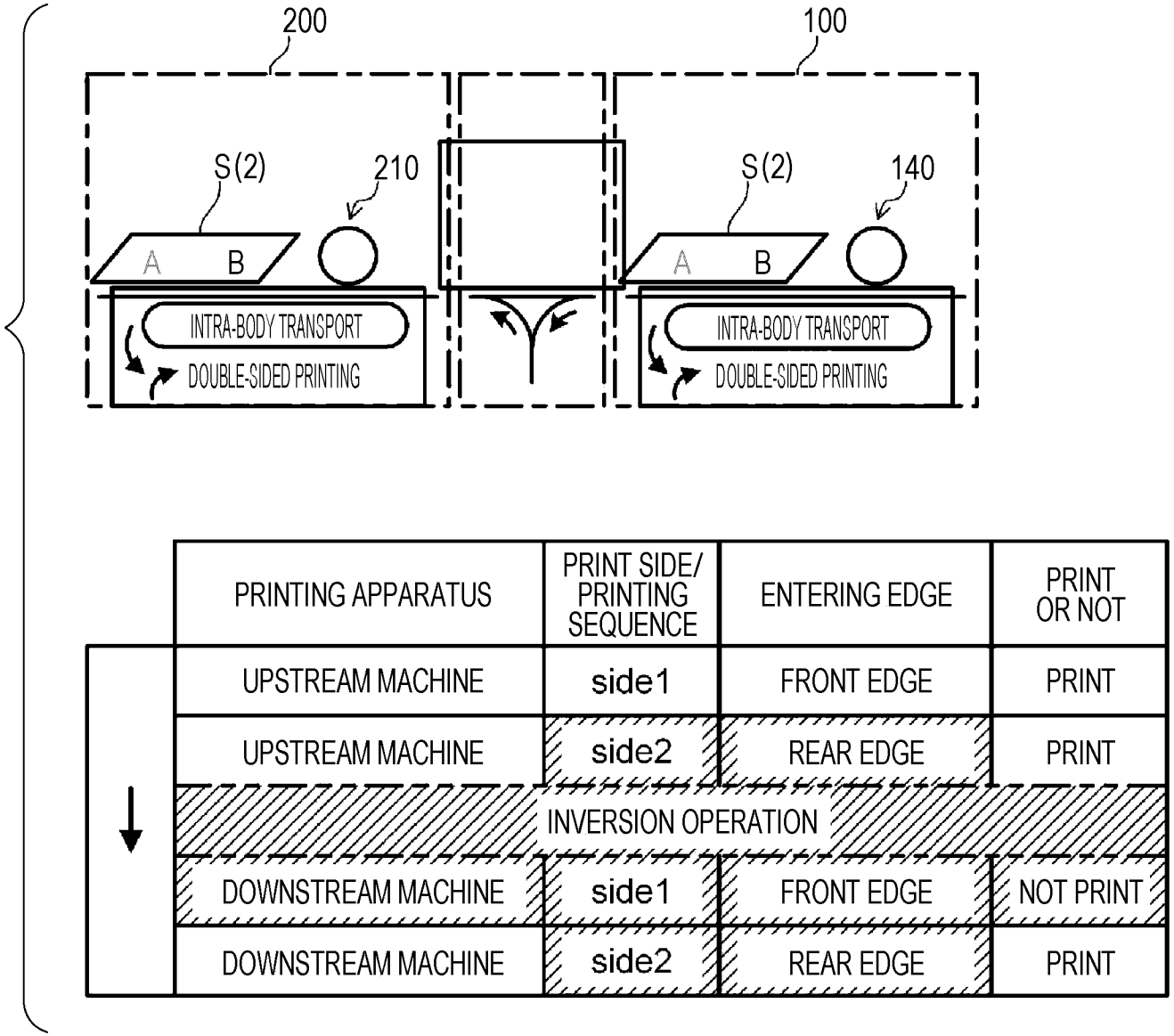
FIG. 7B is a diagram illustrating path setting and transport control to change the position of paper entering the fusers alternately in a double-sided print job illustrated in FIG. 7A.

Here, FIG. 7B shows a transport control example where a process of forming an image "A" on the first side of paper is performed by the first image forming apparatus 100, then the paper is inverted by the inversion transporter (second inversion transporter) in the first image forming apparatus 100 and sent into the fixer 160 (second entry), and the inverted paper is further inverted by the first inversion transporter and supplied to the second image forming apparatus 200.

By this transport control, processing different from that in the case of FIG. 7A is performed. For example, unlike the case of FIG. 7A, the third entering edge of the paper that enters the fixer 230 (fixing nip part NP1) of the second image forming apparatus 200 becomes the paper "front edge", and at this time, printing is not performed by the second image forming apparatus 200.

Thus, the present embodiment can effectively prevent the occurrence of damage to paper without adding a configuration for correcting curl, wrinkles, or the like, thus ensuring the quality of printed matter.

Still another case and solution will be described with reference to FIG. 8A and FIG. 8B.

Figure 8A:
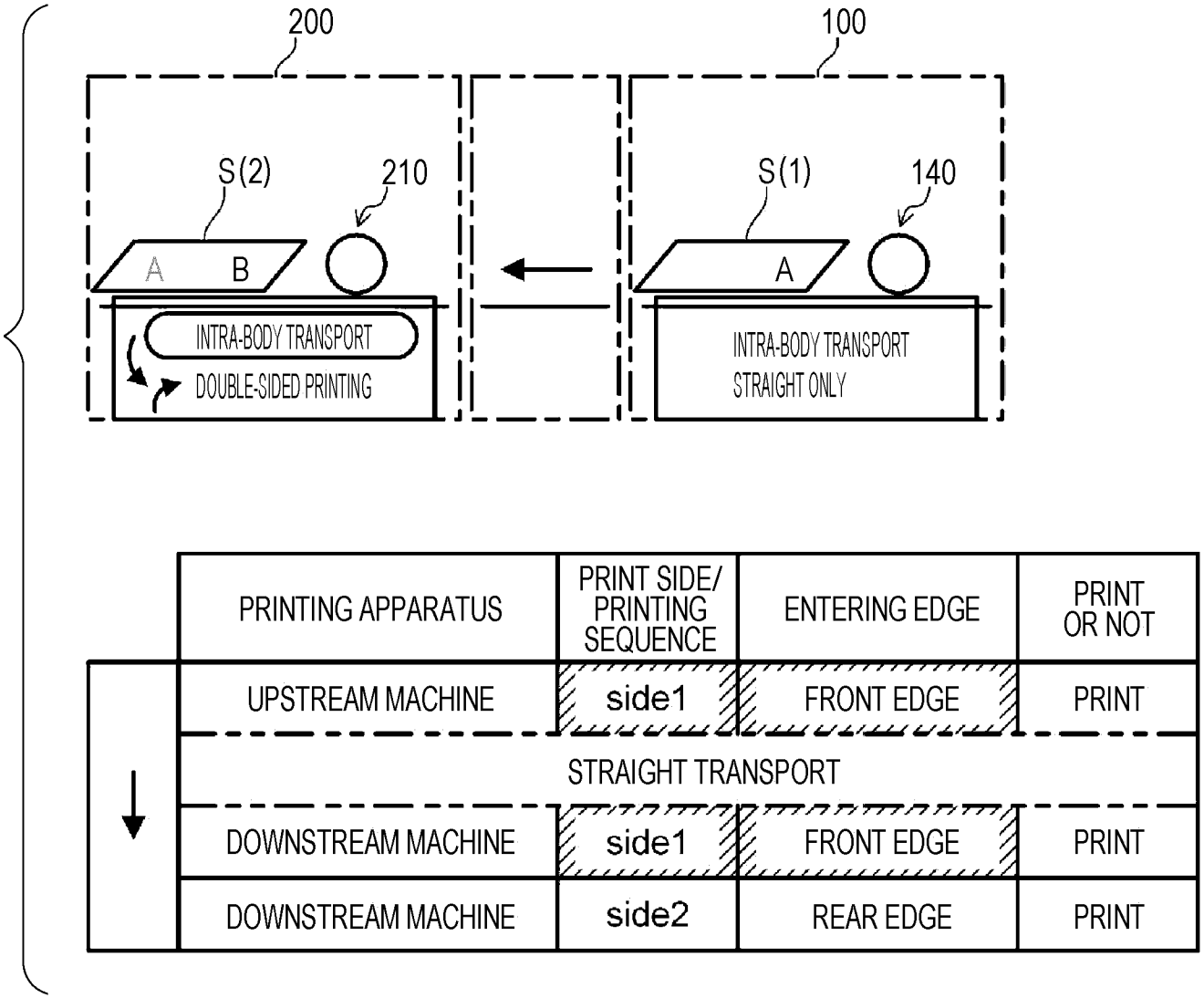
FIG. 8A is a diagram illustrating a case where the position of paper entering the fusers is continuously the same.
Figure 8B:
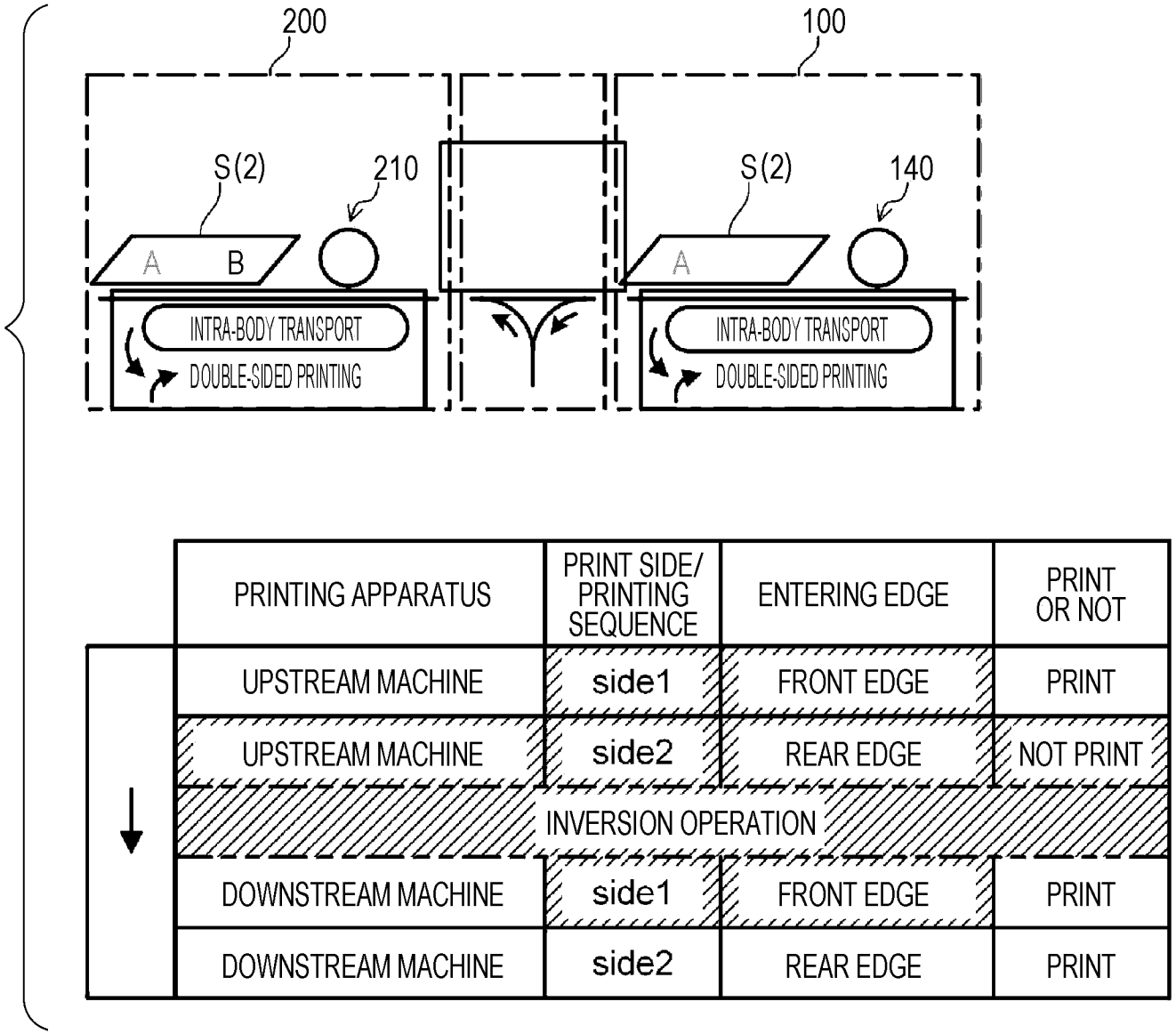
FIG. 8B is a diagram illustrating path setting and transport control to change the position of paper entering the fusers alternately in a double-sided print job illustrated in FIG. 8A.

Here, FIG. 8A is a diagram illustrating an operation, the position of paper, etc. in another print job that can cause damage to paper, in other words, a diagram showing the "first transport control content" in the present invention. On the other hand, FIG. 8B is a diagram illustrating a control method to prevent the position (the sides and the front and rear edges) of paper from being continuously the same when passing through (entering) the fixing nip part NP1 in the print job illustrated in FIG. 8A, in other words, a diagram showing the "second transport control content" in the present invention.

The case shown in FIG. 8A assumes a print job in which the first image forming apparatus 100 performs single-sided printing (here, forms an image "A" on the first side S (1) of paper), and the second image forming apparatus 200 performs double-sided printing (forms an image "A" of a different color on the first side S (1) and an image "B" on the second side S (2)).

In this case, it is advantageous in terms of productivity etc. that on the paper ejected from the first image forming apparatus 100 with the first side (side 1) up and sent to the second image forming apparatus 200, printing on the first side is performed with the position unchanged, and then printing is performed on the second side of the paper that has been inverted through the third inversion transporter. Therefore, conventional systems specify (set) the transport path as described above, and perform paper transport and printing control along the set path.

However, when paper transport and printing is performed using the transport path as described above, the first entering edge and the second entering edge become the same (in this case, the front edge) as shown in the "entering edge" column of the table. Thus, there is a problem that damage to paper is likely to occur especially when the paper is thin as described above.

Therefore, in the present embodiment, in the case of FIG. 8A, after the execution of a printing (image formation and fixing) process in the first image forming apparatus 100, the paper is inverted in position in the first image forming apparatus 100 through the above-mentioned second inversion part, and after that, the paper is passed through the fixer 160 without forming an image, and is further inverted in position by the first inversion part (inter-apparatus medium inversion part) and supplied to the second image forming apparatus 200. The second image forming apparatus 200 as the downstream machine executes a paper transport and printing process similar to conventional one (see FIG. 8B).

By performing such paper transport control (in this example, increasing the number of position inversions by two and increasing the number of entries into the fixing nip part NP1 by one as compared with conventional one), occurrence of damage to paper when printing is performed by the two image forming apparatuses 100 and 200 can be prevented.

Still another case and solution will be described with reference to FIG. 9A and FIG. 9B.

Figure 9A:
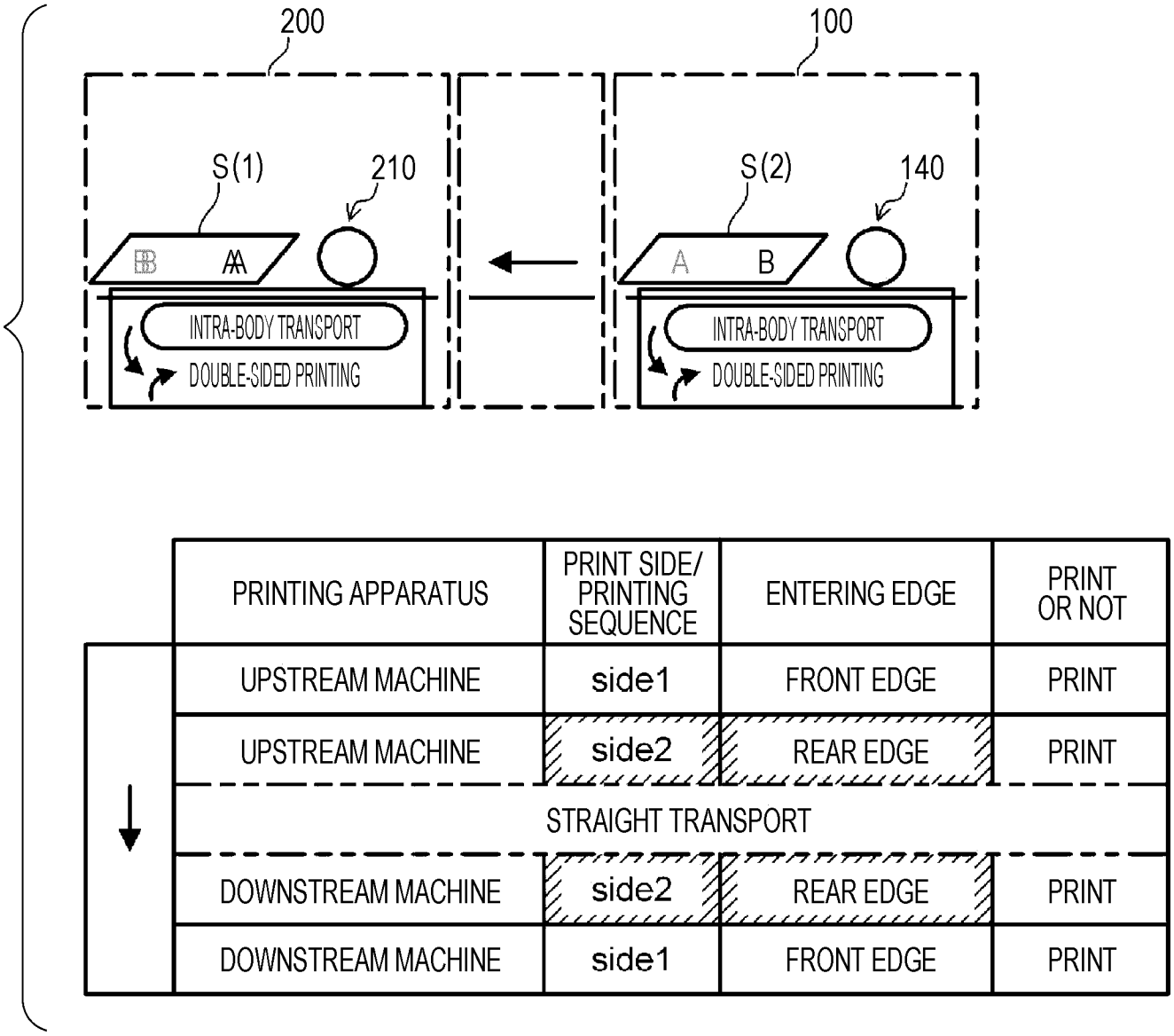
FIG. 9A is a diagram illustrating a case where the position of paper entering the fusers is continuously the same.

Here, FIG. 9A is a diagram illustrating an operation, the position of paper, etc. in another print job that can cause damage to paper, in other words, a diagram showing the "first transport control content" in the present invention. On the other hand, FIG. 9B is a diagram illustrating a control method to prevent the position (the sides and the front and rear edges) of paper from being continuously the same in the print job illustrated in FIG. 9A, in other words, a diagram showing the "second transport control content" in the present invention.

The case shown in FIG. 9A is a case of a print job in which the first image forming apparatus 100 and the second image forming apparatus 200 both perform double-sided printing.

In this case, the first image forming apparatus 100 prints an image "A" on one side of paper and an image "B" on the other side, individually, and then the second image forming apparatus 200 prints an image "A" in another color such that it overlaps the existing image "A" on the one side of the paper, and an image "B" in another color such that it overlaps the existing image "B" on the other side.

In this case, it is advantageous in terms of productivity etc. that, as shown in FIG. 9A, the paper is supplied from the first image forming apparatus 100 to the second image forming apparatus 200 with the second side of the paper (side 2 on which the image "B" is formed) up, the second image forming apparatus 200 prints the image "B" on the second side and then prints the image "A" on the first side of the paper that has been inverted through the third inversion transporter.

Therefore, conventional systems determine (set) the transport path (first transport path) as shown in the table of FIG. 9A, and perform paper transport and printing control along the set path.

However, when paper transport and printing is performed using the transport path as described above, the second entering edge and the third entering edge become the same (in this case, the rear edge) as shown in the "entering edge" column of the table. Thus, there is a problem that damage to paper is likely to occur especially when the paper is thin as described above.

Therefore, in the present embodiment, in the case of FIG. 9A, after double-sided printing (image formation and fixing) on paper is performed by the first image forming apparatus 100, the paper is inverted in position through the above-mentioned first inversion part (inter-apparatus medium inversion part), and supplied to the second image forming apparatus 200.

In this way, by adding one inversion of the paper position between the image forming apparatuses 100 and 200 through the first inversion transporter, the entering edge of the paper sent into the fixer 230 after entering the fixer 160 is changed from the conventional "rear edge"→the "rear edge" to the "rear edge"→the "front edge", that is, alternated. Thus, such control can prevent occurrence of damage to paper.

Further, in this case, the side of the paper finally output from the second image forming apparatus 200 is the same as the conventional one (in this case, the first side). Therefore, in this example, as shown in the table of FIG. 9B, control is performed to change the sequence of print pages.

Specifically, the first image forming apparatus 100 prints an image "B" on one side (side 2) of paper, then prints an image "A" on the other side (side 1) through the second inversion part, and then the paper is inverted in position through the first inversion part (inter-apparatus medium inversion part) and supplied to the second image forming apparatus 200 with the image "B" side (side 1) up.

Figure 9B:
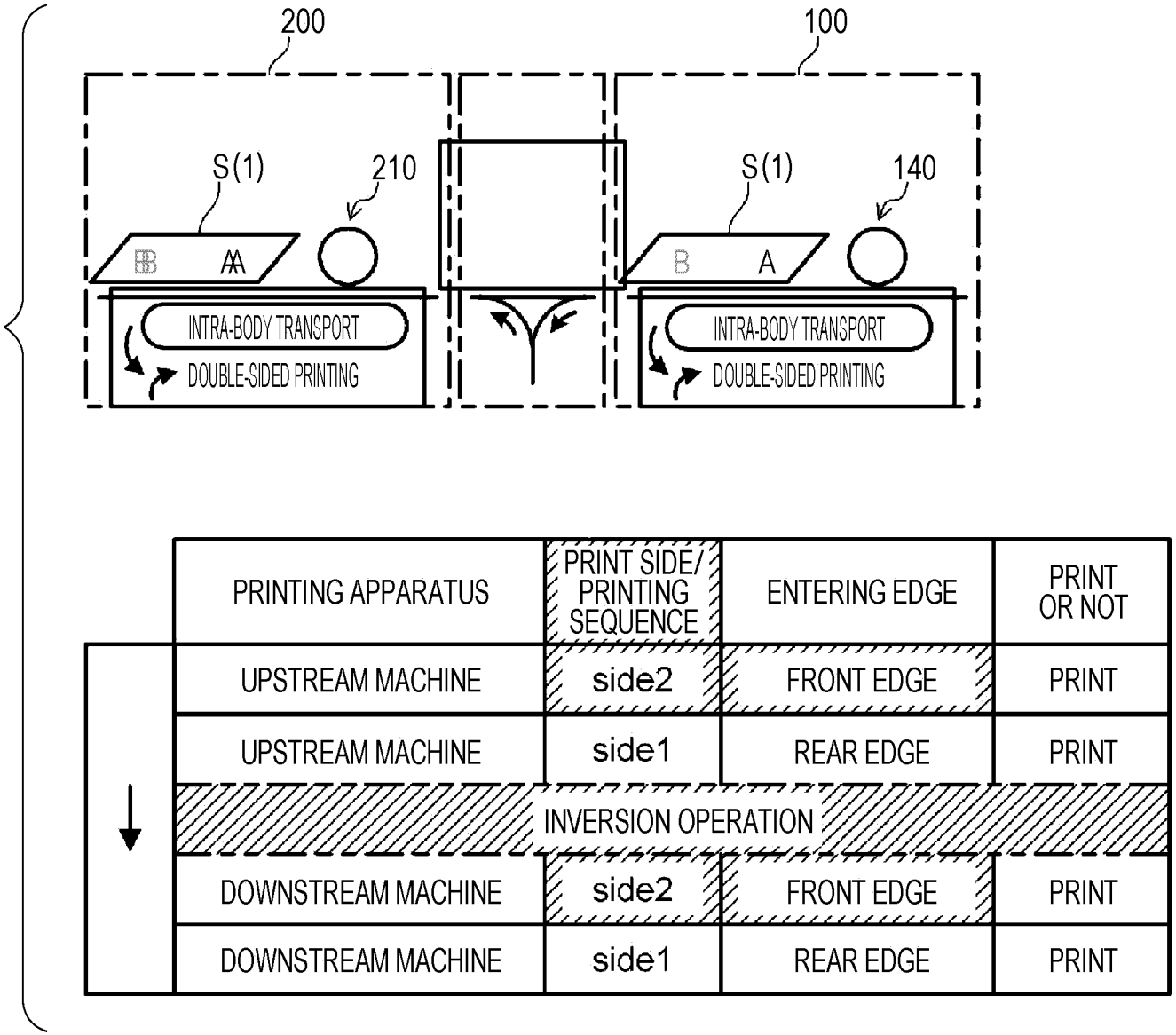
FIG. 9B is a diagram illustrating path setting and transport control to change the position of paper alternately in a double-sided print job illustrated in FIG. 9A.

After that, the second image forming apparatus 200 prints an image "B" in another color such that it overlaps the existing image "B" on the one side (side 2) of the paper, inverts the paper in position through the third inversion part, and then prints an image "A" in another color such that it overlaps the existing image "A" on the other side (see FIG. 9B).

Thus, by appropriately changing print pages so that the side of paper ejected from the second image forming apparatus 200 is the same side as in conventional control, additional settings of various processes in the post-processing apparatus 300 described with reference to FIG. 1, for example, can be eliminated or simplified.

Further, processing to change pages of print images as described above can accommodate a configuration in which the inversion mechanism R2 described with reference to FIG. 1, for example, is not provided. In other words, even in a configuration including the inversion mechanism R2, the need to change the position of paper using the inversion mechanism R2 is eliminated, so that productivity is improved.

Figure 10:
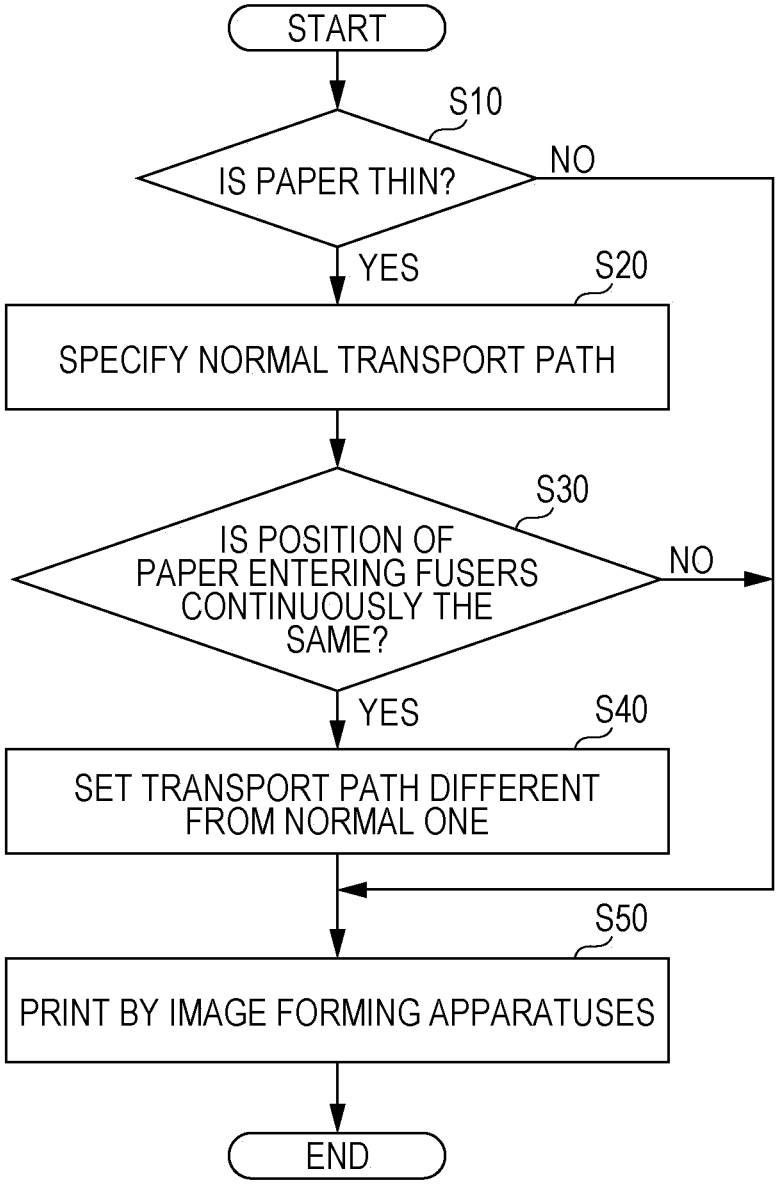
FIG. 10 is a flowchart illustrating a characteristic process in the image forming system of the present embodiment.

Next, with reference to the flowchart of FIG. 10, a specific example of paper transport control at the time of execution of a print job will be described in which an image is formed on a sheet of paper by two machines, the first image forming apparatus 100 and the second image forming apparatus 200.

In this example, the controller 101 of the first image forming apparatus 100 mainly performs processing. Instead, the controller 201 of the second image forming apparatus 200 may mainly perform processing. Alternatively, a processor of another apparatus constituting the system may mainly perform processing in cooperation with the controller 101 of the first image forming apparatus 100.

In step S10 after a print job is received from the external device such as a PC, the controller 101 of the first image forming apparatus 100 determines whether or not paper to be used is thin paper, referring to, for example, a paper setting profile.

Here, the controller 101 determines whether or not the paper to be used in the print job is thin, depending on whether or not the basis weight of the paper is less than a predetermined threshold value.

If the controller 101 determines that the paper is not thin (step S10, NO), it determines that damage such as wrinkles will not occur to the paper, skips processing in steps S20 to S40 described later, and performs normal printing processing in step S50. That is, in step S50, the controller 101 controls as before to perform processing of paper transport and the respective printing processes (formation and fixing of toner images) by the two image forming apparatuses 100 and 200 (for example, see FIG. 4A and FIG. 4B).

On the other hand, if the controller 101 determines that the paper is thin (step S10, YES), it proceeds to step S20.

In step S20, the controller 101 specifies or identifies (so to speak, temporarily sets) a normal transport path in the print job, and proceeds to step S30. In this example, the controller 101 determines, as the "normal transport path", a transport path by which the time from when the paper is fed into the first image forming apparatus 100 to when the paper is ejected from the second image forming apparatus 200 is the shortest. Step S20 corresponds to processing to "determine the first transport control content" in the present invention.

In next step S30, the controller 101 determines whether or not the position of the paper entering the individual fusers (each fuser) is continuously the same. In the present embodiment, the "individual fusers" refer to the individual fixing nip parts NP1, that is, the fixer 160 of the first image forming apparatus 100 and the fixer 230 of the second image forming apparatus 200.

Here, if the controller 101 determines that the position of the paper is not continuously the same (step S30, NO), it determines that damage such as wrinkles will not occur to the paper, skips processing in step S40, and performs a normal printing operation in step S50. That is, in step S50, the controller 101 controls as before to perform processing of paper transport and the respective printing processes (formation and fixing of toner images) by the two image forming apparatuses 100 and 200, using the normal transport path (see step S20) (for example, see FIG. 4A and FIG. 4B).

On the other hand, if the controller 101 determines that the position of the paper entering the individual fusers is continuously the same (step S30, YES), it proceeds to step S40.

In step S40, the controller 101 sets (so to speak, changes or resets) the paper transport path in the print job to a second transport path that is a new path different from the normal one.

Specifically, in step S40, the controller 101 changes and sets the transport path so that (1) at least the initial edge of the paper S in the traveling direction (the front edge or the rear edge) does not continuously enter the individual fusers (the fixing nip parts NP1), and (2) the same side of the paper S (the front side or the back side) entering the individual fusers (the fixing nip parts NP1) does not continuously face upward.

As described above with reference to FIG. 9A and FIG. 9B, the controller 101 may perform additional setting in step S40 to change the image formation sequence (print page sequence) as necessary.

Step S40 corresponds to processing to "set the second transport control content" in the present invention.

In step S50 after step S40, the controller 101 performs printing process control (paper transport and image formation processing) using the second transport path etc. set in step S40.

As described in detail above, when printing is performed on paper S two or more times by the two image forming apparatuses 100 and 200, the image forming system 10 in the present embodiment controls to prevent the position of the paper S entering the fixers from being continuously the same.

That is, in the image forming system 10 of the present embodiment, when images are formed on paper by both the first image forming apparatus 100 and the second image forming apparatus 200, the first transport control content is determined in which the paper is transported in the first image forming apparatus 100 and the second image forming apparatus 200, and when in the first transport control content, the paper that has been processed by the first fuser is processed by the second fuser in the same position, the second transport control content is set such that the paper that has been processed by the first fuser is processed by the second fuser in a different position.

The image forming system 10 having such a configuration, when performing printing by the two upstream and downstream image forming apparatuses (100 and 200), can prevent occurrence of damage to paper at low cost, thus ensuring the quality of printed matter.

In the above embodiment, the image formers of a type that forms a toner image on a recording medium (paper) by an electrophotographic method are used, and the fixers apply heat (heat energy) and pressure to paper to fix a toner image, which is not limiting.

As another example, image formers that eject energy ray (e.g. UV)-curable ink from an inkjet head to form an ink image on a recording medium (paper) may be used. In this case, the fixers may be a configuration to emit (apply) energy rays (e.g. UV light) to a recording medium (paper) on which an ink image is formed to fix the ink image.

In the above-described embodiment, as the mechanism (system) of the inversion parts that invert paper (a recording medium), a switchback transport system that reverses the front and back sides and the front and rear edges of paper is used, which is not limiting. The present invention can also be applied, as a configuration to reverse (only) the front and back sides of paper, to an image forming system including a so-called twisting inversion part.

Although embodiments of the present invention have been described and illustrated in detail, the disclosed embodiments are made for purposes of illustration and example only and not limitation. The scope of the present invention should be interpreted by terms of the appended claims. That is, the present invention can be implemented in various forms without departing from its scope or its major features.

What is claimed is:

1. An image forming system comprising:

a first image forming apparatus including a first fixer that fixes an image formed on a recording medium to the recording medium;

a second image forming apparatus including a second fixer that fixes an image formed on the recording medium to the recording medium, the second image forming apparatus being connected to a downstream side of the first image forming apparatus in a transport direction of the recording medium; and a hardware processor that determines first transport control content in which the recording medium is transported in the first image forming apparatus and the second image forming apparatus, when an image is formed on the recording medium both in the first image forming apparatus and in the second image forming apparatus, and sets second transport control content so that the recording medium that has been processed by the first fixer is processed in a different position by the second fixer, when in the first transport control content, the recording medium that has been processed by the first fixer is processed in the same position by the second fixer.

2. The image forming system according to claim 1, wherein the first and second fixers apply at least one of energy or pressure to the recording medium.

3. The image forming system according to claim 1, wherein the first fixer is disposed, in the transport direction, downstream of a first image former that forms a toner image on the recording medium, and the second fixer is disposed, in the transport direction, downstream of a second image former that forms a toner image on the recording medium.

4. The image forming system according to claim 1, wherein each of the first and second image forming apparatuses includes an inversion part that reverses front and back sides of the recording medium when an image is formed on a second side of the recording medium.

5. The image forming system according to claim 4, wherein the inversion part of the first image forming apparatus is disposed in a transport path for transporting the recording medium that has passed through the first fixer back to a path on an inlet side of the first image forming apparatus, and the inversion part of the second image forming apparatus is disposed in a transport path for transporting the recording medium that has passed through the second fixer back to a path on an inlet side of the second image forming apparatus.

6. The image forming system according to claim 1, further comprising:

an inter-apparatus medium inversion part that reverses front and back sides of the recording medium that has passed through the first fixer and supplies the recording medium to the second image forming apparatus.

7. The image forming system according to claim 6, wherein the inter-apparatus medium inversion part is disposed in the first image forming apparatus or between the first image forming apparatus and the second image forming apparatus.

8. The image forming system according to claim 1, wherein the position of the recording medium is front and back sides and front and rear edges in the transport direction.

9. The image forming system according to claim 1, wherein the hardware processor controls transport of the recording medium using one of the first transport control content and the second transport control content, according to an image formation condition, when an image is formed on the recording medium both in the first image forming apparatus and in the second image forming apparatus.

10. The image forming system according to claim 9, wherein the image formation condition is content of setting by a user.

11. The image forming system according to claim 9, wherein the image formation condition is a basis weight of the recording medium and whether single-sided printing or double-sided printing is performed.

12. A transport control method in an image forming system comprising a first image forming apparatus including a first fixer that fixes an image formed on a recording medium to the recording medium, and a second image forming apparatus including a second fixer that fixes an image formed on the recording medium to the recording medium, the method comprising:

determining first transport control content in which the recording medium is transported in the first image forming apparatus and the second image forming apparatus, when an image is formed on the recording medium both in the first image forming apparatus and in the second image forming apparatus; and setting second transport control content so that the recording medium that has been processed by the first fixer is processed in a different position by the second fixer, when in the first transport control content, the recording medium that has been processed by the first fixer is processed in the same position by the second fixer.

13. A non-transitory recording medium storing a computer readable program causing a computer, in an image forming system comprising a first image forming apparatus including a first fixer that fixes an image formed on a recording medium to the recording medium, and a second image forming apparatus including a second fixer that fixes an image formed on the recording medium to the recording medium, to perform:

determining first transport control content in which the recording medium is transported in the first image forming apparatus and the second image forming apparatus, when an image is formed on the recording medium both in the first image forming apparatus and in the second image forming apparatus; and setting second transport control content so that the recording medium that has been processed by the first fixer is processed in a different position by the second fixer, when in the first transport control content, the recording medium that has been processed by the first fixer is processed in the same position by the second fixer.

* * * * *